US010350748B2

(12) United States Patent
Michael et al.

(10) Patent No.: US 10,350,748 B2
(45) Date of Patent: Jul. 16, 2019

(54) TOOL STORAGE UNIT HAVING A MOVEABLE HOUSING

(71) Applicant: Matco Tools Corporation, Stow, OH (US)

(72) Inventors: Dan Michael, Parma, OH (US); James Szpak, Cleveland Heights, OH (US); Jason Tilk, Cleveland Heights, OH (US); Rob Vystricil, Middlefield, OH (US); Robert Allen, Richmond Heights, OH (US); Bill Rabbitt, Chesterland, OH (US); Shawn Dellinger, Cleveland, OH (US)

(73) Assignee: Matco Tools Corporation, Stow, OH (US)

( * ) Notice: Subject to any disclaimer, the term of this patent is extended or adjusted under 35 U.S.C. 154(b) by 0 days.

(21) Appl. No.: 15/429,530

(22) Filed: Feb. 10, 2017

(65) Prior Publication Data

US 2017/0232607 A1 Aug. 17, 2017

Related U.S. Application Data

(60) Provisional application No. 62/294,850, filed on Feb. 12, 2016.

(51) Int. Cl.
*B25H 3/04* (2006.01)
*B25H 3/00* (2006.01)
(Continued)

(52) U.S. Cl.
CPC ..... *B25H 3/04* (2013.01); *A47B 45/00* (2013.01); *A47B 46/00* (2013.01); *A47B 51/00* (2013.01);
(Continued)

(58) Field of Classification Search
CPC . B25H 1/16; B25H 3/00; B25H 3/026; B25H 1/12; B25H 3/028; B25H 3/04; B25H 3/02; B25H 1/10; A47B 21/0073; A47B 45/00; A47B 81/00; A47B 9/12; A47B 81/064; A47B 51/00; A47B 46/00; A47B 2220/0013; A47B 17/02; A47B 46/005; A47B 67/00; A47B 13/08; A47B 83/00; A47B 83/045; A47B 13/081; A47B 31/00; A47B 88/457; A47B 88/42; A47B 2088/901; F16M 11/046; B62B 3/02; B62B 2202/48
USPC ..... 312/312, 196, 205, 319.5, 319.8, 249.8, 312/198, 201, 200, 119, 122, 139.2, 290, 312/902
See application file for complete search history.

(56) References Cited

U.S. PATENT DOCUMENTS 168,879 A 10/1875 Colbert
184,375 A 11/1876 Hansen
(Continued)

*Primary Examiner* — Hiwot E Tefera
(74) *Attorney, Agent, or Firm* — Hahn Loeser & Parks LLP

(57) ABSTRACT

Examples of the present invention include tool storage units and methods for storing tools. In examples of the present invention, a tool storage unit comprises a moveable housing with a guide system for allowing movement of the moveable housing in at least one direction. In various examples, the moveable housing is engaged with a base unit and is moved relative to the base unit by a moving mechanism. The moving mechanism moves the moveable housing to provide access to and/or conceal, at least in part, the moveable housing.

17 Claims, 18 Drawing Sheets

(51) Int. Cl.

| | |
|---|---|
| ***B25H 1/12*** | (2006.01) |
| ***A47B 45/00*** | (2006.01) |
| ***B25H 1/16*** | (2006.01) |
| ***A47B 46/00*** | (2006.01) |
| ***B25H 3/02*** | (2006.01) |
| ***A47B 88/42*** | (2017.01) |
| ***A47B 88/457*** | (2017.01) |
| ***A47B 51/00*** | (2006.01) |
| *A47B 88/90* | (2017.01) |

(52) U.S. Cl.
CPC ..... *A47B 88/42* (2017.01); *A47B 88/457* (2017.01); *B25H 1/12* (2013.01); *B25H 1/16* (2013.01); *B25H 3/00* (2013.01); *B25H 3/02* (2013.01); *B25H 3/026* (2013.01); *A47B 2088/901* (2017.01)

(56) References Cited

U.S. PATENT DOCUMENTS 494,764 A 4/1893 Sutton
1,459,930 A * 6/1923 Riehle ..... B25H 1/04 144/285
1,507,760 A * 9/1924 Sutherland ..... A47B 85/06 108/64
1,559,705 A 11/1925 Jackson
2,369,664 A 2/1945 Froelich
2,525,208 A 10/1950 Clink
2,848,293 A 8/1958 Jurgens et al.
2,923,584 A 2/1960 Broderick, Jr.
3,730,378 A 5/1973 Albinson et al.
4,088,380 A * 5/1978 Watts ..... A47B 29/00 223/106
4,120,549 A 10/1978 Bureau
4,733,703 A 3/1988 Cimino
4,784,446 A 11/1988 Newhouse
4,976,450 A 12/1990 Ellefson
4,989,291 A 2/1991 Parent
5,016,948 A 5/1991 Welch et al.
5,147,122 A 9/1992 Short
5,224,531 A 7/1993 Blohm
5,257,860 A 11/1993 Slivon
5,332,305 A 7/1994 Slivon et al.
5,443,311 A 8/1995 Kadlecek et al.
5,497,878 A 3/1996 Sandonato
5,588,659 A 12/1996 Boes et al.
5,634,649 A 6/1997 Breining et al.
5,642,898 A 7/1997 Wise
5,725,037 A 3/1998 Faulhaber
5,797,666 A * 8/1998 Park ..... A47B 21/0073 312/223.3
5,951,129 A 9/1999 Stein
6,109,709 A 8/2000 Holcomb et al.
6,113,200 A 9/2000 Slivon
6,116,067 A 9/2000 Myers et al.
6,135,584 A 10/2000 Happ
6,267,393 B1 * 7/2001 Mengrone ..... A45C 5/14 280/30
6,336,691 B1 1/2002 Maroney et al.
6,374,649 B1 4/2002 Holcomb et al.
6,394,566 B1 5/2002 Slivon et al.
6,454,107 B1 * 9/2002 Belanger ..... B65D 5/724 206/556
6,578,938 B2 6/2003 Norman et al.
6,712,434 B2 3/2004 Knab et al.
6,746,091 B2 6/2004 Friar et al.
6,811,232 B2 11/2004 Doan et al.
6,976,744 B2 12/2005 Hay et al.
7,559,614 B2 7/2009 Zheng
7,647,956 B1 1/2010 Cona et al.
7,665,709 B2 * 2/2010 Cvek ..... A47B 21/007 108/25
7,699,413 B2 4/2010 Liao
8,033,620 B2 * 10/2011 Retchloff ..... B25H 3/00 312/290
D648,128 S * 11/2011 Clayton ..... D3/279
8,079,651 B2 * 12/2011 Cvek ..... A47B 21/007 312/196
8,157,337 B2 4/2012 Manalang et al.
8,162,330 B2 4/2012 Melkumyan et al.
8,215,728 B2 7/2012 Mehmen
8,292,379 B2 10/2012 Hernandez
8,360,538 B2 1/2013 Retchloff
8,608,260 B2 12/2013 Wishlade
8,668,209 B1 3/2014 Anzivino et al.
8,678,523 B2 * 3/2014 Carr ..... A47B 81/064 312/306
8,813,916 B2 * 8/2014 Schilling ..... B66B 9/02 174/37
8,827,387 B2 9/2014 Grela
8,833,881 B2 * 9/2014 Manniso ..... A47B 88/90 211/10
8,870,308 B2 10/2014 Freimuth
8,991,951 B2 * 3/2015 Lee ..... F16M 11/046 312/319.5
9,439,507 B2 * 9/2016 Liu ..... A47B 9/04
9,486,075 B2 * 11/2016 Liu ..... A47B 83/00
9,808,930 B1 * 11/2017 Liu ..... A47B 31/00
9,815,189 B1 * 11/2017 Liu ..... B25H 1/16
2001/0028208 A1 10/2001 Reilly
2002/0130598 A1 9/2002 Schmidt
2003/0015851 A1 1/2003 Hahn
2003/0107307 A1 * 6/2003 Chen ..... A47B 46/00 312/289
2004/0070319 A1 4/2004 Miller
2005/0035696 A1 2/2005 Parise et al.
2005/0046315 A1 * 3/2005 Doane ..... A47B 17/02 312/196
2005/0062370 A1 3/2005 Miller
2005/0265129 A1 * 12/2005 Agnoff ..... A47B 51/00 368/206
2007/0029746 A1 2/2007 Brennan, Jr.
2007/0035671 A1 * 2/2007 Ryu ..... H04N 5/64 348/794
2007/0262683 A1 * 11/2007 Creed ..... A47B 67/00 312/290
2007/0274042 A1 11/2007 Jackson et al.
2008/0012455 A1 1/2008 Zheng
2008/0231154 A1 9/2008 Rudduck et al.
2009/0085448 A1 4/2009 Zhang
2009/0102335 A1 * 4/2009 Hancock ..... A47B 21/0073 312/223.3
2009/0249592 A1 * 10/2009 Thieman ..... A47F 5/0823 24/591.1
2010/0314978 A1 * 12/2010 Manalang ..... B25H 3/021 312/243
2011/0109211 A1 5/2011 Kirkeby et al.
2011/0266936 A1 * 11/2011 Moran ..... A47B 51/00 312/312
2012/0176008 A1 7/2012 Grela et al.
2012/0194750 A1 * 8/2012 Carr ..... A47B 81/064 348/841
2013/0069510 A1 * 3/2013 Wexler ..... A47B 67/04 312/309
2014/0132129 A1 5/2014 Deneweth et al.
2014/0175962 A1 * 6/2014 Hollenstein ..... A47B 51/00 312/319.5
2014/0217861 A1 * 8/2014 Cole ..... A47B 45/00 312/205
2014/0265771 A1 * 9/2014 Koester ..... A47F 10/00 312/234
2014/0306590 A1 10/2014 Grela
2017/0215578 A1 * 8/2017 Cole ..... A47B 45/00
2017/0303683 A1 * 10/2017 Guivol ..... A47B 51/00

* cited by examiner

TOOL STORAGE UNIT HAVING A MOVEABLE HOUSING

This application claims priority to, and the benefit of, U.S. Provisional Patent Application No. 62/294,850 filed on Feb. 12, 2016 with the United States Patent Office, which is hereby incorporated by reference.

BACKGROUND

Field

This invention relates generally to tool storage units, and more particularly, to a storage system for storing tools or other items in association with a moveable housing.

Description of the Related Art

Tool chests are used for storing tools and other items. Although tool chests may include multiple components which are stacked, tool chests lack the flexibility of providing or adding one or more compartment(s) which may conceal tools or other stored items in an alternative orientation, relative the tool chest or independent of a tool chest. Moreover, tool chests also lack the flexibility to also display the tools or other stored items above, behind, and/or independent of the tool chest, in a controlled manner. Therefore, it would be desirable to increase the flexibility of a tool chest for storing tools and other items.

SUMMARY

Particular examples include a tool storage unit for storing tools in association with a moveable housing. Particular examples also include methods for the same.

Particular examples include a tool storage unit. The tool storage unit comprises a moveable housing being engagable with a guide system. The guide system allows movement of the moveable housing in at least one direction. The guide system is secured to a base unit. The moveable housing may be positioned at least in the base unit when in the closed position. A moving mechanism engages the moveable housing. The moving mechanism moves the moveable housing relative the base unit between a closed position where the moveable housing is positioned at least partially in the base unit to an open position where the moveable housing extends at least partially outside the base unit. In various examples, the moveable mechanism may also move the moveable housing in other positions, such as a first and second position. In the open position, the moveable housing extend at least in part above the top of the base unit. The moving mechanism is also configured to selectively lower the moveable housing relative to the base unit to the closed position. The moving mechanism may also selectively secure the moveable housing in its open position. Finally, the base unit may be configured to be attached to or removably connected to a tool chest.

Additional examples include a method for storing tools. Particular examples of a method for storing tools include providing a tool storage unit as described above. A step in the method for storing tools includes securing one or more tool hangers on a display wall of the moveable housing. The display wall may be configured to move with the moveable housing. Another step in the method for storing tools includes moving the moveable housing in at least one direction relative the base unit to provide access to the one or more tool hangers from a front side of the display wall. The one or more tools being accessible when the moveable housing is in an open position. Yet another step in the method for storing tools includes moving the moveable housing in at least one direction relative the base unit to conceal the display wall within the base unit. The display wall and/or one or more tools being concealed when the moveable housing is in the closed position. The moveable housing may be further controlled by actuating a moving mechanism engaged with the moveable housing where the moving mechanism moves the moveable housing relative the base unit between the closed position and an open position.

The foregoing and other examples, objects, features, and advantages will be apparent from the following more detailed descriptions of particular examples, as illustrated in the accompanying drawings wherein like reference numbers represent like parts.

DETAILED DESCRIPTION OF THE DRAWINGS

DETAILED DESCRIPTION

Figure 2:
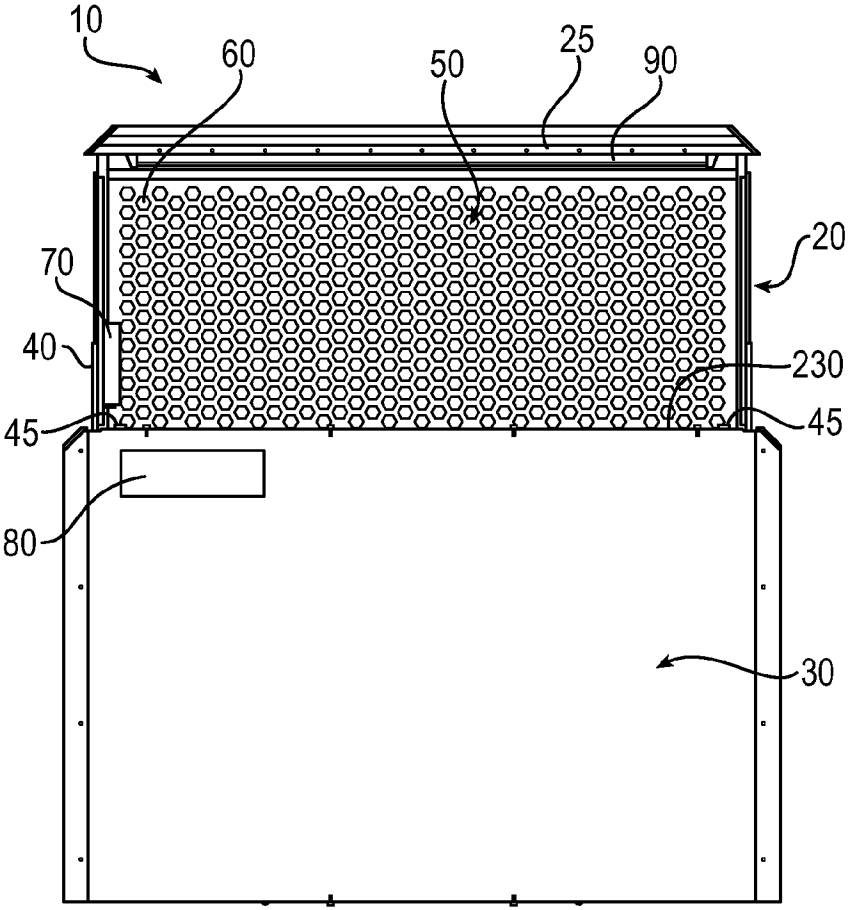
FIG. 2 is a front view of a tool storage unit, according to an example.

The invention comprises a storage apparatus and methods for a storage unit and storing tools or other items, respectively. More particularly, the present invention comprises storing tools or other items in association with a moveable housing. In examples, the moveable housing translates vertically and is configured to secure or suspend tools or other items from a mounting structure arranged in the moveable housing. In various examples, the moveable housing may also be configured to secure the suspended tools or other items in association with a base unit. The base unit may be further configured to mount to a tool chest or other structure. The details will be discussed in greater detail below with the figures illustrating various examples.

The invention comprises methods for storing tools. Examples of the methods for storing tools include providing a tool storage unit configured to raise a moveable housing from a base unit. The tool storage unit may comprise various compartments or mechanisms for storing a collection of tools or other items. The various tool storage compartments may be a component of or attached to the moveable housing for movement with the moveable housing. One example of a storage system, discussed in greater detail below, includes a wall or panel to which tools or other items may be attached or hung. Other examples of tool storage compartments include drawers, bins, hooks, or hanging mechanisms positioned on a vertical wall for suspending tools, etc. The tool storage unit may comprise one type of tool storage system or a combination of different tool storage systems.

In one example, a tool storage unit comprises a moveable housing and a base unit. The base unit allows the moveable housing to be substantially or entirely concealed and locked when access to the tools is not desired, or when the tool storage unit is in a closed position. To conceal the moveable housing, the base unit surrounds or forms a perimeter wall about some or all of the moveable housing. The moveable housing may be surrounded by the base unit when in a closed position. In examples, the moveable housing may be surrounded by the base unit at the back and sides as well as possibly the top and/or bottom, thereby being surrounded by the base unit on up to six sides. In an example, the base unit may be of a generally cuboid shape, and can specifically be of rectangular cross-section in two or more dimensions. It, however, is understood that various shapes of greater or lesser complexity, and shapes having round portions, chamfered portions, stepped portions, etc., can be substituted or added without departing from the scope and spirit of the invention. For example, the base unit and/or the moveable housing may be formed of a curved configuration or may comprise more or less than four sides, a top, and/or a bottom.

In an example, the base unit comprises at least one opening from which the moveable housing may extend from the base unit. In an example, the opening is at the top of the base unit. In a closed position the moveable housing may include a portion that cooperates with the base unit to enclose the tools or other items to prevent access thereto. Alternatively, the base unit may have a top which is removed, relocated, or repositioned in order to create the opening, exposing the moveable housing. In an example, the base unit may form a perimeter wall about the moveable housing with an aperture at the top of the base unit. From the closed position, the moveable housing translates in a vertical direction from within the base unit through the aperture at the top of the base unit. The moveable housing may fully, substantially, or partially extend from the base unit through the aperture at the top of the base unit to an open position. The moveable housing may also be positioned in one or more intermediate positions between the fully closed position and the fully open position. Each intermediate position may provide limited access to designated portions of the moveable housing and tool storage compartments. This feature may be used to limit access to particular tools based upon particular users. The movement of the moveable housing may be vertical, horizontal or otherwise.

Various examples include engaging the moveable housing in a guide system, such as one or more tracks for supporting and/or stabilizing the moveable housing as it is moved between positions. The track may connect the moveable housing to the base unit for movement between the two structures. In some examples, the track is secured to the base unit wherein the moveable housing is configured to be concealed within the base unit when in the closed position. A portion of the track may be configured to translate or telescope from the base unit with the movement of the moveable housing.

In various examples and in addition to guiding the moveable housing, the guide system may be oriented vertically for supporting the load of the moveable housing as it raises vertically from the base unit. The guides or tracks may transfer the load of the moveable housing to the base unit. Examples of the guide system that may be used include drawer slides positioned vertically, pulley systems, tongue and groove configurations, wheels on rails, slotted configurations, or the like. In one particular example, a track is positioned to each side of the moveable housing. To prevent multiple tracks from binding, a balancing system, associated with either the moveable housing and/or the base unit, may be further incorporated to maintain equal load distribution at each track and/or equal or consistent distance between each side of the moveable housing and the base unit. In other examples, one track or multiple tracks may be used to accomplish the same. Further, the track may extend the full height of the moveable housing and/or base unit or only a partial height of the moveable housing or base unit. The one or more tracks may additionally be used to provide limits on the distance the moveable housing travels in relation to the base unit. These limits may be adjustable depending upon the desired access to the moveable housing.

A moving or lifting system engages the moveable housing wherein the moving system moves the moveable housing, such as relative to the base unit. The moving system may be a component of the guide system or the moving system may be provided independently. Examples of a moving system include hydraulic systems, pneumatic systems, pulley systems, ratcheting systems, hoisting systems, or the like. In some examples, the moving system is a scissor lift. For example, the moving system may comprise a scissor lift acting on the moveable housing. Moreover, multiple moving systems may be used. In an example, the moving system is a scissor lift comprising a central pivot point where two arms intersect and about which the two arms pivot. A first end of each arm engages the base unit and a second end of each arm engages the moveable housing. To lift the moveable housing, in a manner in which the scissor lift is positioned generally below the moveable housing, the first end of the first arm and the first end of the second arm, which are both engaging the base unit, are moved in a direction toward the other. Similarly, the second end of the first arm and the second end of the second arm, which are both engaging the moveable housing, similarly move toward the other.

The moving system, base unit or moveable housing may further comprise guiding structures such as rollers, rails, pins, reduced friction surfaces, a combination thereof, or the like at the points of engagement. These guiding structures may be attached to the scissor lift arms and/or the base unit or moveable housing. The guiding structures provide assistance in guiding the movement between each component and/or reducing the resistance or friction between each component. By example, a roller may be pivotally attached to each end of the scissor lift arm wherein each roller engages and guides the scissor lift across the base unit or moveable housing. Alternatively, the guiding structures may also be used to generate or increase friction at the intermediate positions. By example, the guiding structures may be configured to increase the resistance or friction to connote a respective position, such as an intermediate position. This may be accomplished by providing friction structures, examples of which include a flat or raised surface on a roller, a recess into which a pin may drop, granular surfaces, a combination thereof, or the like. It is also appreciated guiding structures, including friction structures, may be provided independent of the moving system or in combination with the moving system or lifting mechanism.

In some examples, the moving system comprises a scissor lift which includes a piston for causing operation of the lift. In these examples, a first piston end is attached to the first arm and a second piston end is attached to the second arm. Each piston end may be attached directly to each arm, respectively. Alternatively, each piston may be attached to mounting bracket which is attached to each arm, respectively. The attachment may include any suitable mechanism, including pivotally, rigidly, rotationally, slidably, etc. In operation, when the piston extends, the scissor lift is driven from a compressed or lowered position to an extended or raised position, as described above.

An actuator may be provided for controlling the moving system. An actuator is any type of motor configured for moving or controlling a mechanism or system. In the example of a moving system comprising a scissor lift, the actuator provides the source of energy for moving the piston and thereby moving the scissor lift between a lowered and a raised positions thereby selectively raising or lowering the moveable panel to an open position, a closed position, or any position there between. The sources of energy may include electric current, hydraulic pressure, pneumatic pressure, or the like. The actuator may be further connected to a controller. The controller is configured to control the amount and direction in which the energy is exerted. In other words, an operator may control the movement of the moveable housing through the various options available on the controller. The controller may be provided locally at the actuator, locally at the tool storage unit, and/or remotely. By example, a remote fob device (i.e. wireless) may be the controller or be configured to communicate with the controller, or a smart phone app may be used to control operation. In some examples, one or more remote controllers, one or more local controllers, or a combination thereof may be used.

In various examples, safety features may be incorporated into the moving system, the track, the actuator, and/or the controller. In an example, the controller or actuator may be configured to raise the moveable housing by a single push of a single button or by another actuator. In contrast, and to prevent a pinching hazard, the controller or actuator may be configured to require a user to maintain pressure on the button or actuator until the moveable housing raises or lowers to the desired position. Alternatively, the controller or actuator may be configured to require the user to apply pressure to multiple buttons or actuators in sequence or in unison in order to raise or lower the moveable housing. Additionally or alternatively, a key switch and/or a lockout/tag-out device may be utilized to activate or deactivate movement of the moveable housing. To further prevent pinch hazards, sensors may be provided at various locations at or near the moving components of the tool storage unit and send a signal to stop or reverse movement of the moveable housing when an obstruction is detected. The sensors may be motion sensors, lasers, torque sensors, pressure sensors, or another suitable sensor to detect the presence of an obstruction.

In some examples, other features may be incorporated into the moving system, the track, the actuator, the controller, or other electrical and/or mechanical components. A torque sensor may be provided to control and/or provide an auto stop or braking feature for the moveable housing. The torque sensor may also be used to communicate and control the movement of the moveable housing to eliminate any coasting or loss of power to the actuator at any position. A current limiting device may also be provided to prevent movement electrical failure or other electrical obstructions.

A manual moving or movement system may be provided as an alternative to or in combination with a powered moving or movement system(s) described above. A manual movement system may be provided as an override or an alternative to the primary movement system. A manual movement system may be provided in combination with another movement system or may be independent of the movement system and/or the tool storage unit. By example, the scissor lift or other moving or movement system may be configured to receive an independent Porta-Power®, pulley system, ratcheting system, gear system, and/or jack system. Alternatively, a Porta-Power®, pulley system, ratcheting system, gear system, and/or jack system may be provided at the tool storage unit.

Examples of the apparatus or methods for storing tools further include securing one or more tool hangers on a wall of the moveable housing wherein the display wall moves with the moveable housing. As discussed above, the one or more tool hangers may comprise or be used in combination with various tool storage compartments, examples of which were previously introduced. The tool hangers are configured to engage and attach to the display wall. In alternative examples, tool hangers may be configured to engage and attach to other portions of the moveable housing. In some examples, the tool hangers may be permanently affixed to the moveable housing and/or the display wall. In other examples the tool hanger may be removably attached to the moveable housing and/or display wall. Examples of attachment may include any suitable system, such as screws, bolts, hinges, hooks, etc. Further, the tool hangers may also be moveably attached to the moveable housing and/or display wall. Examples of moveable attachment mechanisms include rotatable attachment, pivotal attachment, slidable attachment, swinging attachment, etc.

In one example, access to the one or more tool hangers is provided from a front side of the display wall in the open position. In the open position a user may gain access to a portion of or all of the display wall and/or moveable housing. Thereby a user may gain access to the tools or other items stored at the display wall and/or moveable housing. In one particular example, the moveable housing is open at a front side. Through the front side, the display wall is exposed and accessible when the moveable housing is in the open position. To increase accessibility, the display wall may further move in relation to the moveable housing. By example, the display wall may translate from the moveable housing through the front side of the moveable housing. Access may be provided through additional sides of the moveable housing. By example, tools stored on a display wall may be accessible from another side or multiple sides of the display wall.

In some examples, the display wall comprises one or more apertures accessible from a front of the moveable housing. In one example, the one or more apertures are shaped like hexagons, or in other words, form hexagonal apertures. The one or more hexagonal apertures receive the one or more tool hangers. By example, a securing portion of the one or more tool hangers may be similarly shaped hexagons. The one or more tool hangers are secured to display housing through the hexagonal aperture. They may be secured by securing mechanism such as a clip mechanism, a pressure mechanism, a hook and loop mechanism, or the like. The securing mechanism may be releasable by applying pressure to the outer extends of the securing mechanism. This may be accomplished by incorporating a spring mechanism within the securing mechanism. Other hanging mechanisms known in the art are contemplated and do not depart from the scope of spirit of the innovation.

In one example, a void is positioned between the display wall and a housing back of the moveable housing. In this example, the void provides separation between the display wall and a back side of the moveable housing. This allows the one or more tool hangers to be inserted through the display wall without being restricted by the moveable housing. Further, the tool hangers may include depth adjustments providing various depths for insertion into the display wall. The depth adjustments provide an adjustment to the amount a tool hanger may extend from the display wall and allow the attachment of the tool hanger to the display aperture to be adjusted based upon the tool or storage compartments being utilized.

In examples of the apparatus and methods for storing tools the moveable housing is raised vertically, relative the base unit, to provide access to the one or more tool hangers. The moving system for moving the moveable housing (i.e. moving mechanism) is discussed in detail above. The moveable housing is configured to move in relation to the base unit. In one example, the moveable housing is moved in a vertical direction. In other examples, the moveable housing may move orthogonal to the base unit or at any angle there between. Thereby, the system for moving the moveable housing may include a driving mechanism and/or tracks for driving and/or guiding, respectively, the moveable housing in a horizontal direction, a rotational direction, and/or in an angled direction. In yet other examples, the moveable housing may follow an oscillating path or arcuate path. In these examples, the base unit may also be shaped in an arcuate configuration.

In various examples of the methods for storing tools, the moveable housing is lowered vertically, relative the base unit, to conceal the display wall within the base unit in the closed position. In contrast to the open position, the moveable housing may be concealed within the base unit in the closed position, to protect stored tools or items from theft for example. Again, the moveable housing may be moved in any direction discussed above and is not limited to the vertical direction. In the closed position, access to the tools stored at the display wall and/or moveable housing may be limited or prevented. This provides access control to the tools and increases the security of the tools. Locking mechanisms may be further incorporated into the moveable housing and/or the base unit, to prevent movement of the moveable housing. This will further prevent access to tools when not in use.

The apparatus and methods for storing tools may further comprise a system for or the step of attaching the base unit to a tool chest. In some examples, the tool chest may be a mobile tool cart. In various examples, the base unit is attached to a back side of the tool chest such that the base unit and the moveable housing is concealed behind the tool chest when the tool storage unit is in a closed position and when facing the tool chest directly from a front side of the tool chest. When in an open position, the moveable housing is substantially above a top surface of the tool chest. Methods for attaching a base unit to the tool chest may include any suitable system or mechanism. The method for attachment may include hidden fasteners to increase the security and to prevent removal of the base unit from the tool chest. This may include a cleat configuration at the top of the base unit and tool chest for example. Removable fasteners may be used to the bottom of the base unit and tool chest. Access may be limited to these removable fasteners due to proximity with the ground surface thereby preventing tampering with the fasteners. Proprietary fasteners or locking fasteners may be used to connect the base unit to the tool chest to provide security if desired. In other examples, the base unit may be attached to other structures, examples of which include vehicles, cabinets, walls, buildings, equipment, tools, benches or the like. The same attachment system used at the tool chest may be used to attach the base unit to these other structures.

In various examples, tool storage unit may comprise a mobile base. In some examples, the mobile base may be permanently or rigidly attached to the base unit. In other examples the mobile base may be removably attached to the base unit. The mobile base is configured to balance the base unit and the moveable housing. In one example, the mobile base may be solely used to transport the tool storage unit from one tool chest, or location, to another. Under this function, the mobile base may only be configured to balance the base unit and the moveable housing when in the closed position. Further, safety features may be added to prevent the moveable housing from rising into the open position when being transported. In another example, the mobile base may be configured to balance the base unit and the moveable housing when in both the open position and in the closed position. In yet another example, the mobile base may be adjustable to be configured to accomplish both purposes identified above, independently. In these examples, the mobile base may comprise a cart. The cart may be attached to the bottom of the base unit. Wheels or braces may extend from the cart and contact a ground surface. To support a tool storage unit, which may have a high center of gravity, the wheels of the cart may extend horizontally from the base unit to offset the sideways forces exerted by this high center of gravity. Similarly, one or more stanchions may extend from the cart and contact or connect to the tool storage unit at a location above the bottom of the base unit to provide alternative or additional support, offsetting the high center of gravity. When the moveable housing is connected to a tool chest, the mobile base may be removed from the tool storage unit and/or the wheels or braces may be configured to disengage the ground surface. Alternatively, the mobile base may be configured to make the tool chest additionally mobile. In other examples, a stationary base may be used to support the tool storage unit, without mobile features such as wheels.

In one example, a horizontal track and travel mechanism may be provided to translate a portion of or the entire moveable housing, from the base unit, positioned to the back side of a tool chest on which it is mounted, across the top surface of the tool chest to the front side of the tool chest or any horizontal position there between. The moveable housing may be translated horizontally in a manner which maintains the moveable track in its upright display position or may additionally be configured to pivot, rotate or collapse into other positions along the horizontal track. Similar mechanical and electrical systems for lifting the moveable housing may be used for translating the moveable housing across the top surface of the tool chest. The generally horizontal track and travel mechanism may be in communication with the base unit, the tool chest, the moveable housing or a combination thereof. Wheel, rollers and/or guides may additionally be provided to guide the moveable housing across the top surface of the tool chest. In various examples, the moveable housing may move in any direction such as between a horizontal or a vertical orientation. Moreover, the moveable housing may move in a combination of directions.

In examples, other features may be incorporated into the tools storage unit independent of or in combination with the features already described. By example, an auxiliary power supply may be provided at the tool storage unit. This auxiliary power supply may include a power strip with one or more outlets. Similarly, other connections or equipment, such as internet access, ethernet connections, connectivity to an electronic device, a modem, etc., may be provided at the tool storage unit. This equipment or these connections may be provided at the tool storage unit or may be provided through a secondary source. By example, the power supply may connect to the power supply of a tool chest. Thereby, an access housing may be provided from the tool storage unit to the tool chest to provide a connection at the tool chest. The access housing allows the power supply to remain concealed within the tool storage unit and the tool chest. Similarly, the power supply for the moving system may be similarly provided. Additionally, the controller may be accessible at a tool chest or independent location through the access housing. The cables of these many connections may be maintained using a cable track which translates or moves with the moveable housing. The cable track is designed to secure the cables and allow the cables to move in an organized fashion with the moveable housing. An example of a cable track is illustrated in the figures. Lights may also be provided at the tool storage unit. In one example, a light bar is provided at the top of the moveable housing for illuminating the display wall. In one particular example, the lights may be LED (light-emitting diode) lights. Multiple lights may be provided throughout the tool storage unit. The lights may also be controlled by the movement of the moveable housing. By example, the light may illuminate corresponding to the position of the moveable panel. By example, the light may illuminate when the moveable housing is in open position and/or fully extends. In some examples, light control be accomplished by using the motor controller, actuator and/or wireless controller. Further, the light may be a mobile light which may also be used as a shop light. A cable control mechanism may be provided at the tool storage unit to allow the shop light to extend from the tool storage unit.

Particular examples of the methods discussed above will now be described in further detail below in association with the figures filed herewith exemplifying the performance of the methods in association with particular examples.

Figure 1:
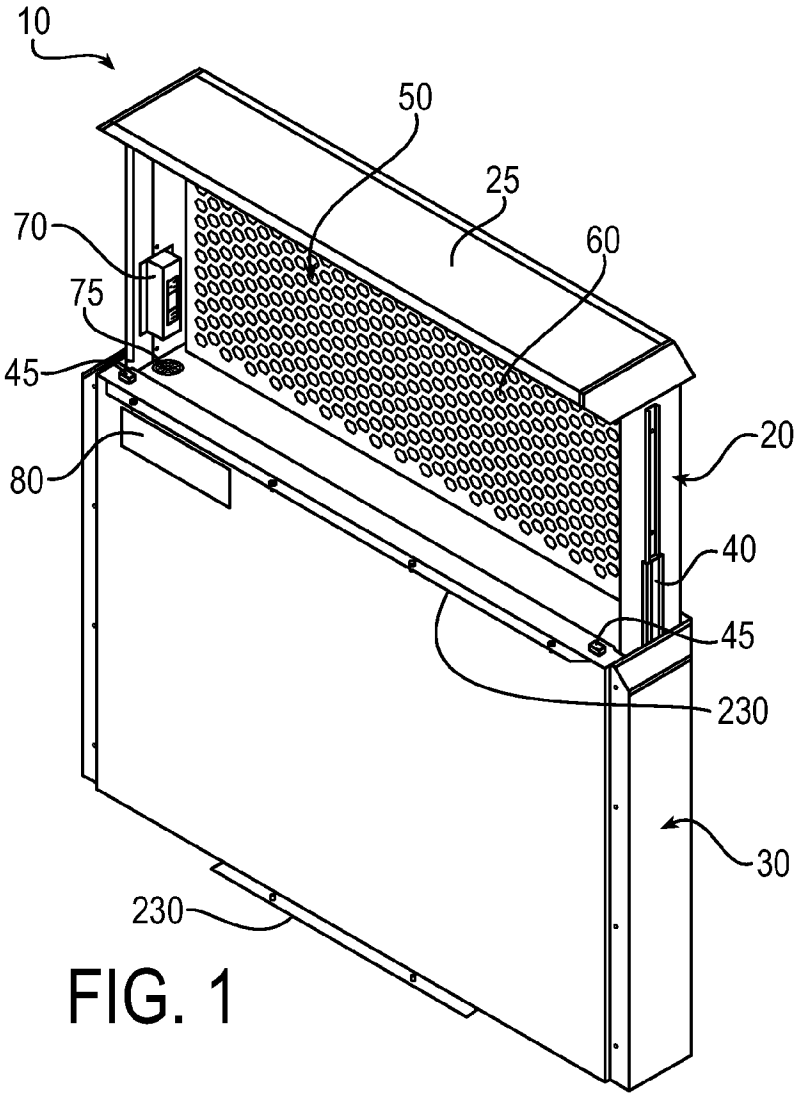
FIG. 1 is a perspective view of a tool storage unit, according to an example.
Figure 5:
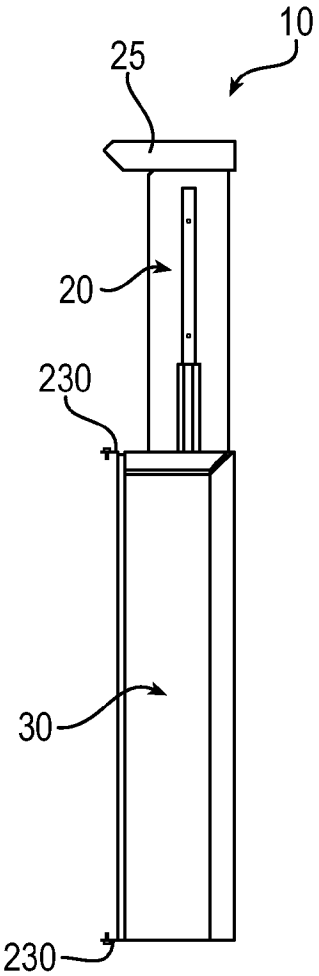
FIG. 5 is a right side view of a tool storage unit, according to an example.
Figure 4:
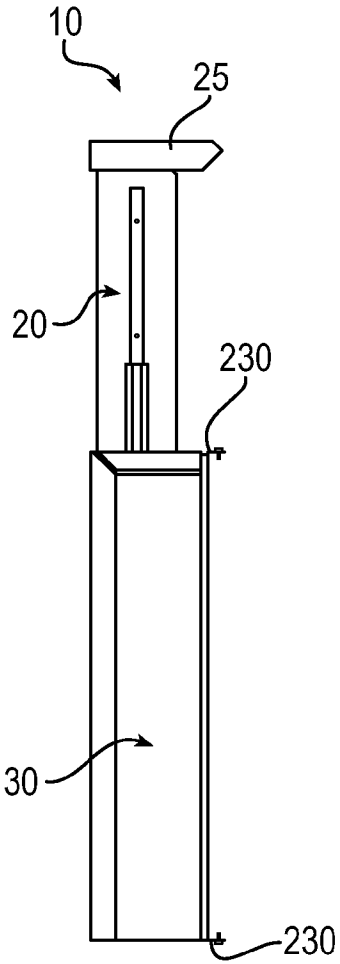
FIG. 4 is a left side view of a tool storage unit, according to an example.
Figure 3:
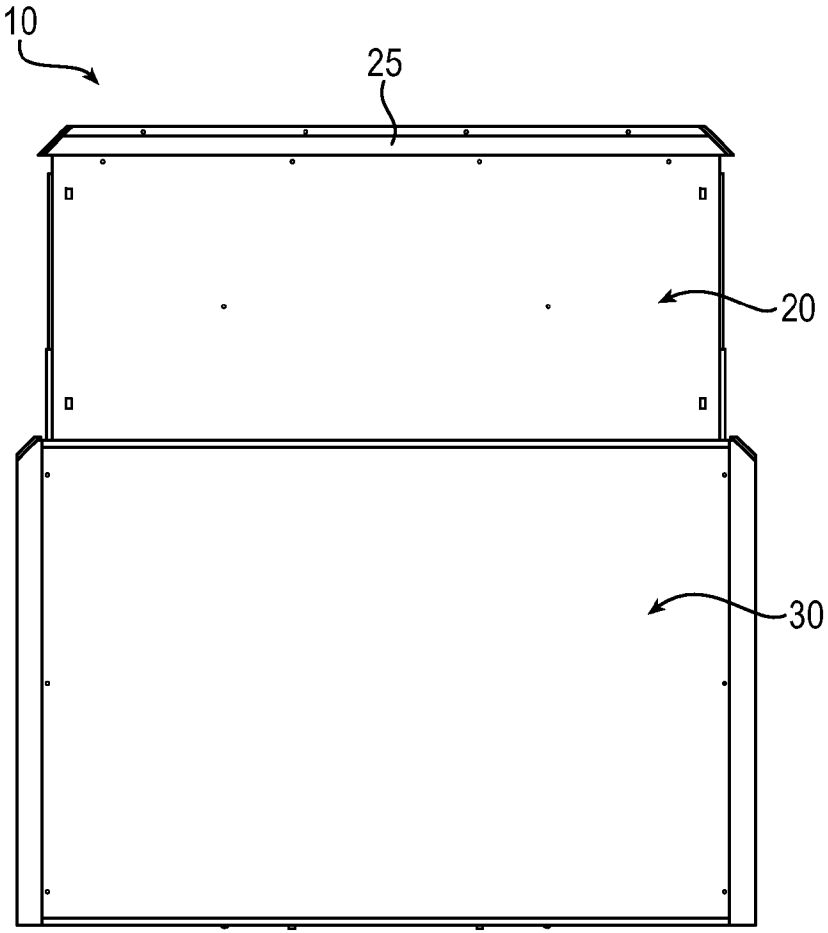
FIG. 3 is a back view of a tool storage unit, according to an example.
Figure 6:
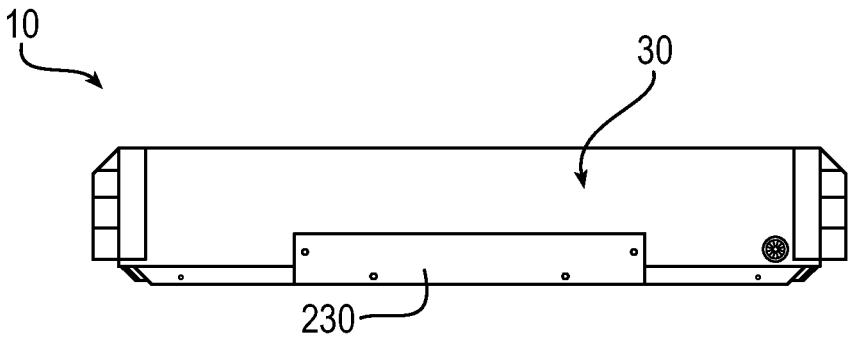
FIG. 6 is bottom view of a tool storage unit, according to an example.
Figure 7:
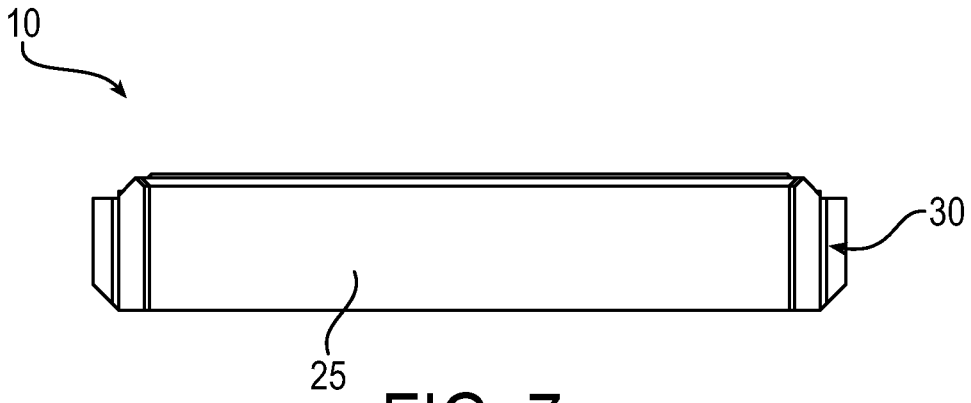
FIG. 7 is a top view of a tool storage unit, according to an example.

With reference to FIGS. 1-7, a tool storage unit 10 is illustrated comprising a moveable housing 20 and a base unit 30 in an open position. The moveable housing 20 is connected to the base unit 30 by a track 40 located at each side of the moveable housing 20 and the base unit 30. As discussed above, the track 40 guides the moveable housing 20 between an open position and a closed position. In FIGS. 1-7, the moveable housing is illustrated in an open position. The moveable housing 20 includes a display wall 50 having display apertures 60 for securing one or more tool hangers. The moveable housing 20 also includes a power strip 70 for providing auxiliary power at the tool storage unit. A grommet 75 is positioned adjacent to the power strip to provide a pathway for the power supply. An access panel 80 is located at the base unit for providing a pathway for one or more auxiliary cables supplying power, communication, internet, etc. from another location, such as a tool chest (see FIG. 38). Further, the power supply to operate the tool storage unit 10 may also be provided through this access panel 80 and connected to a controller or actuator. An attachment system or members 230 is illustrated on the base unit 30 for attaching the tool storage unit 10 to another structure, such as a tool chest. FIGS. 1-2 further illustrate an example of sensors 45 for sensing an obstruction to stop or reverse movement of the moveable housing when an obstruction is detected.

Figure 8:
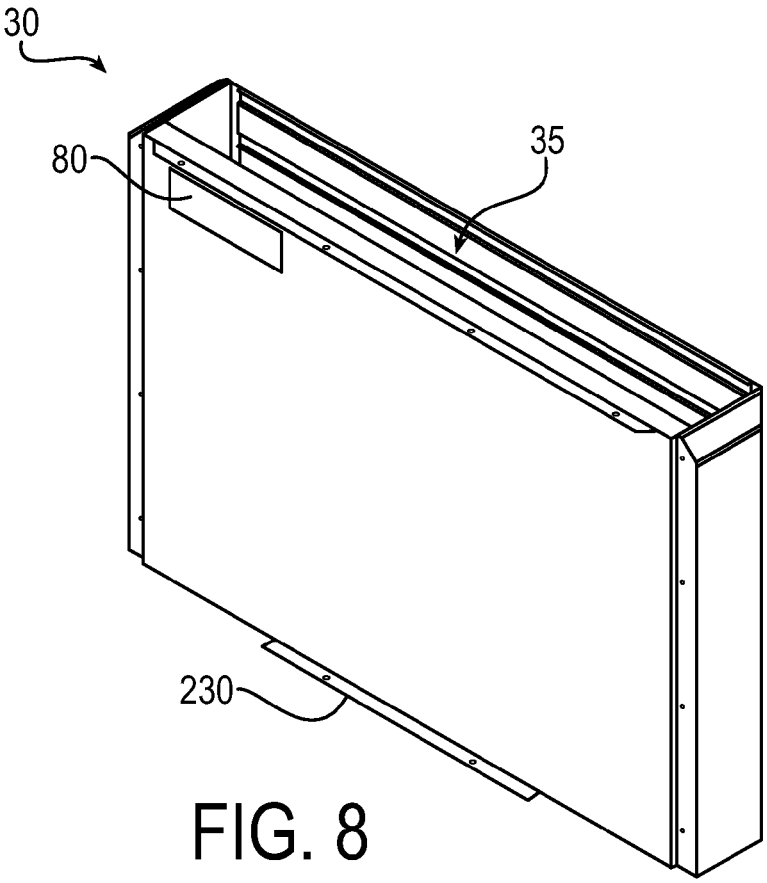
FIG. 8 is a perspective view of a base unit of a tool storage unit, according to an example.
Figure 9:
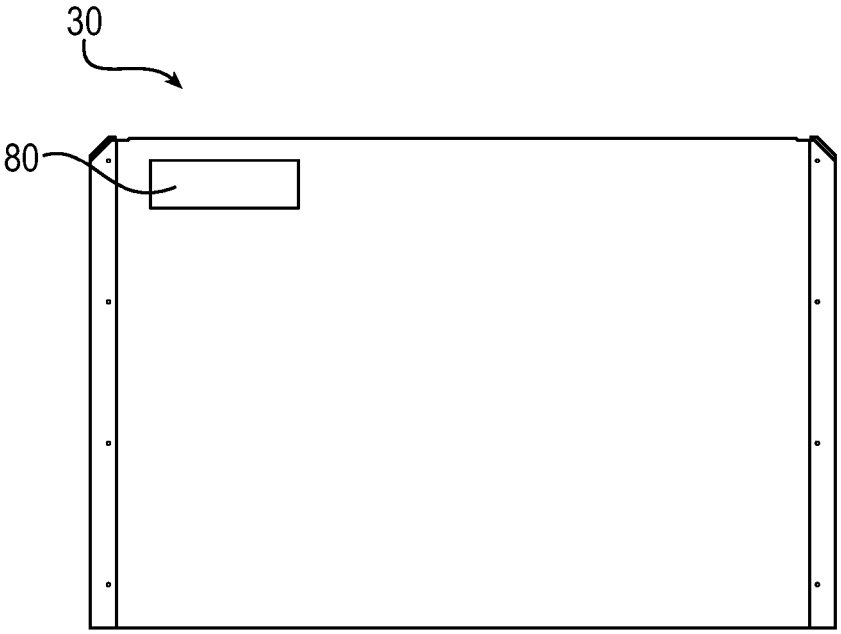
FIG. 9 is a front view of a base unit of a tool storage unit, according to an example.
Figure 10:
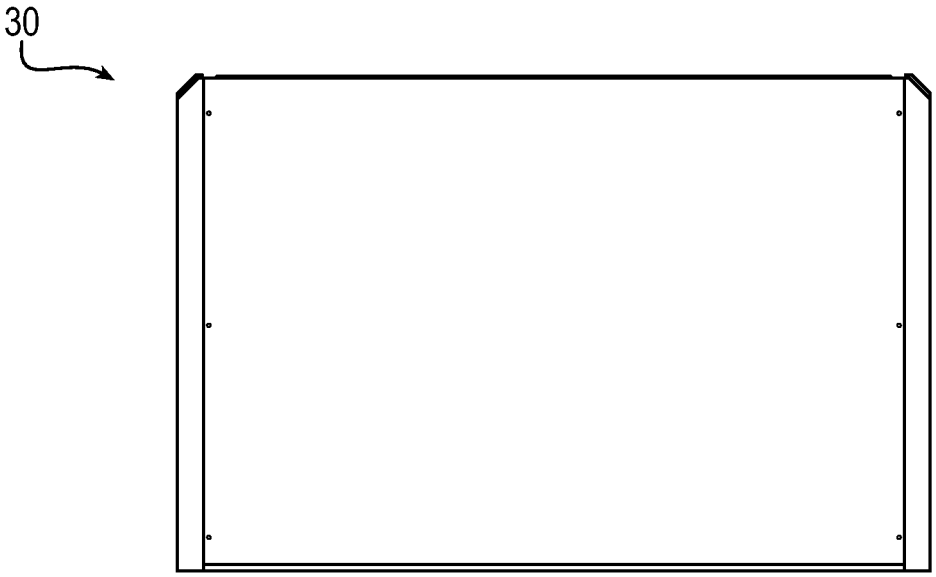
FIG. 10 is a back view of a base unit of a tool storage unit, according to an example.
Figure 11:
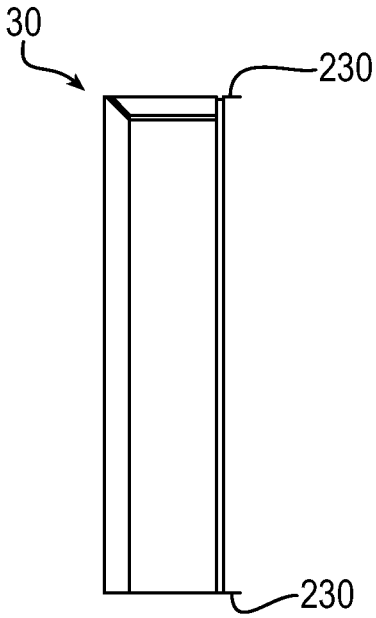
FIG. 11 is a left side view of a base unit of a tool storage unit, according to an example.
Figure 12:
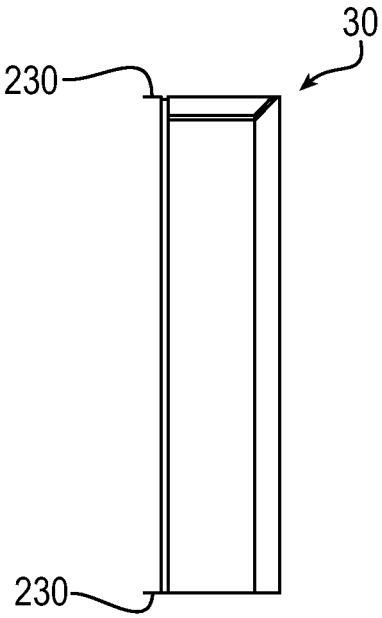
FIG. 12 is a right side view of a base unit of a tool storage unit, according to an example.
Figure 13:
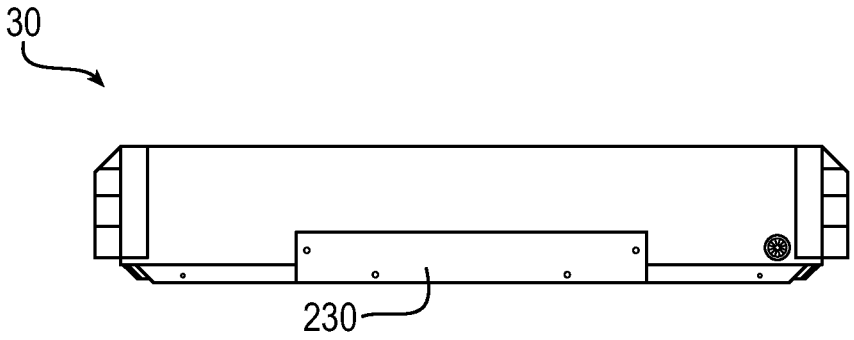
FIG. 13 is a bottom view of a base unit of a tool storage unit, according to an example.
Figure 14:
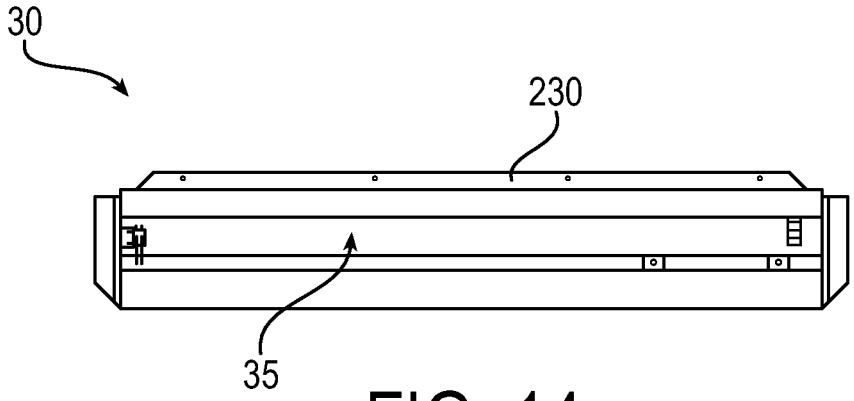
FIG. 14 is a top view of a base unit of a tool storage unit, according to an example.
Figure 15:
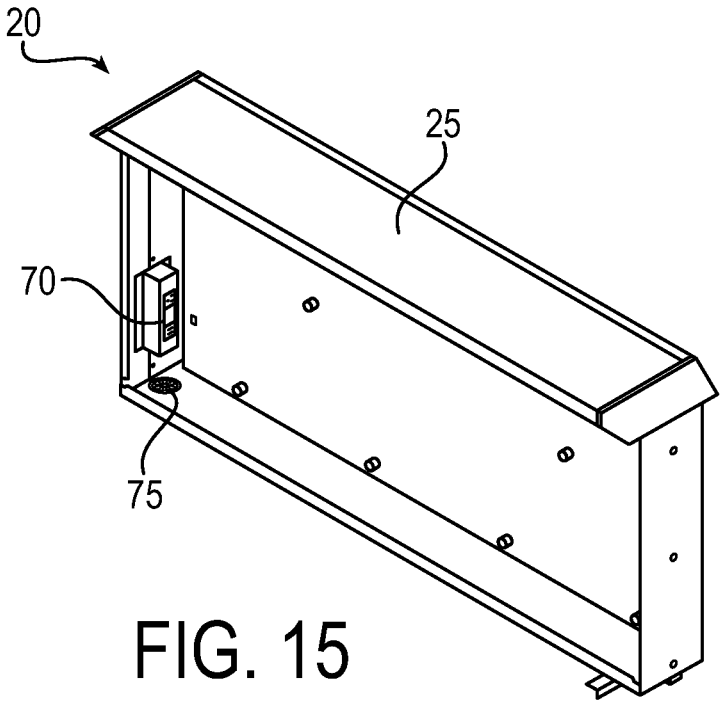
FIG. 15 is a perspective view of a moveable housing of a tool storage unit looking from above, according to an example.
Figure 16:
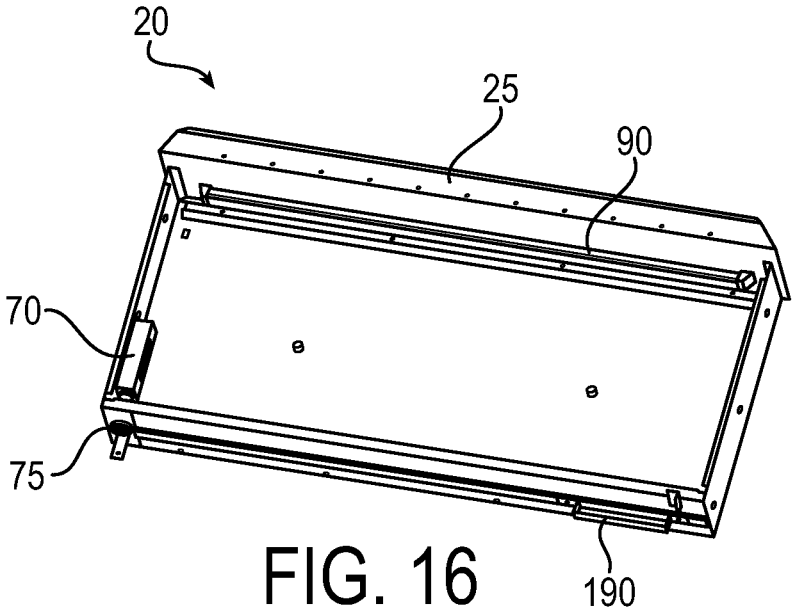
FIG. 16 is a perspective view of a moveable housing of a tool storage unit looking from below, according to an example.
Figure 17:
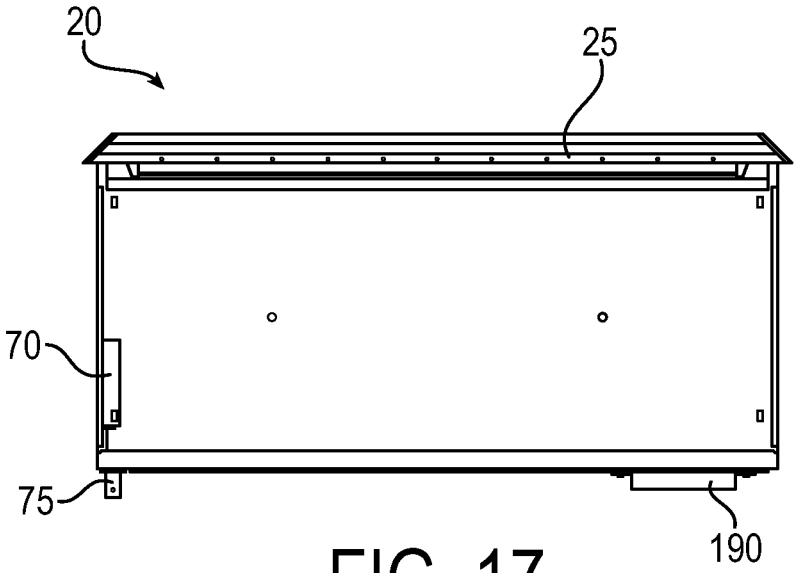
FIG. 17 is a front view of a moveable housing of a tool storage unit, according to an example.
Figure 18:
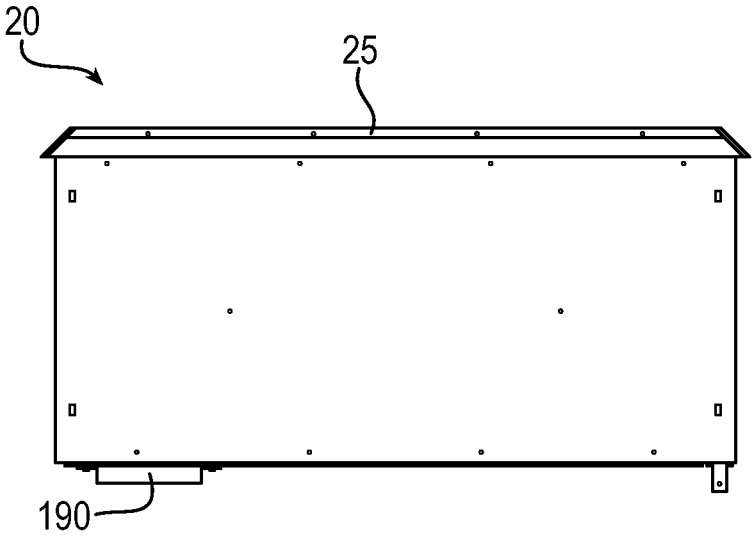
FIG. 18 is a back view of a moveable housing of a tool storage unit, according to an example.
Figure 19:
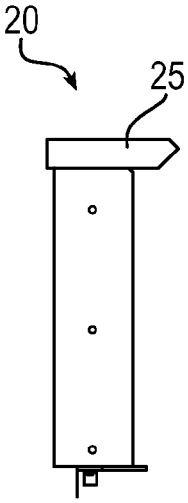
FIG. 19 is a left side view of a moveable housing of a tool storage unit, according to an example.
Figure 20:
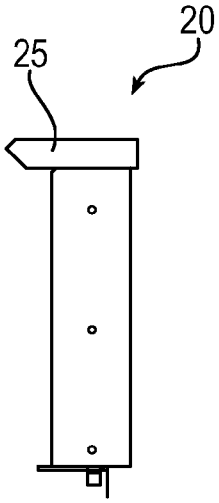
FIG. 20 is a right side view of a moveable housing of a tool storage unit, according to an example.
Figure 21:
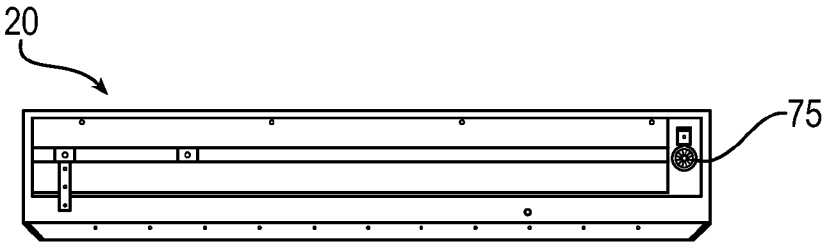
FIG. 21 is a bottom view of a moveable housing of a tool storage unit, according to an example.
Figure 22:
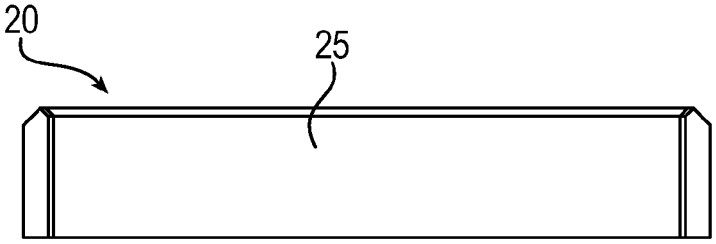
FIG. 22 is a top view of a moveable housing of a tool storage unit, according to an example.

An example of the base unit 30 is illustrated in FIGS. 8-14. The base unit 30 includes a base unit opening 35 from which the moveable housing may extend. The base unit opening 35 opens into an internal cavity of the base unit. When in the closed position, the moveable housing may be substantially within the internal cavity. When in the open position, the moveable housing may be substantially outside of the internal cavity. The moveable housing may also share the internal cavity with a moving mechanism (See FIGS. 28-36). FIGS. 8, 11-14 also illustrate attachment system or members 230 provided to the front side of the base unit to the bottom and the top of the base unit. The attachment system or members may be provided at any location on the base unit, and may be integral with the base unit. Here, the attachment members are shown as cleats extending from the base unit with apertures for receiving fasteners. The fasteners attach to an independent structure through the apertures for securing the base unit 30 to the independent structure, such as a tool chest (See FIG. 38). Also illustrated in FIGS. 8 and 9 is an access panel 80.

Figure 23:
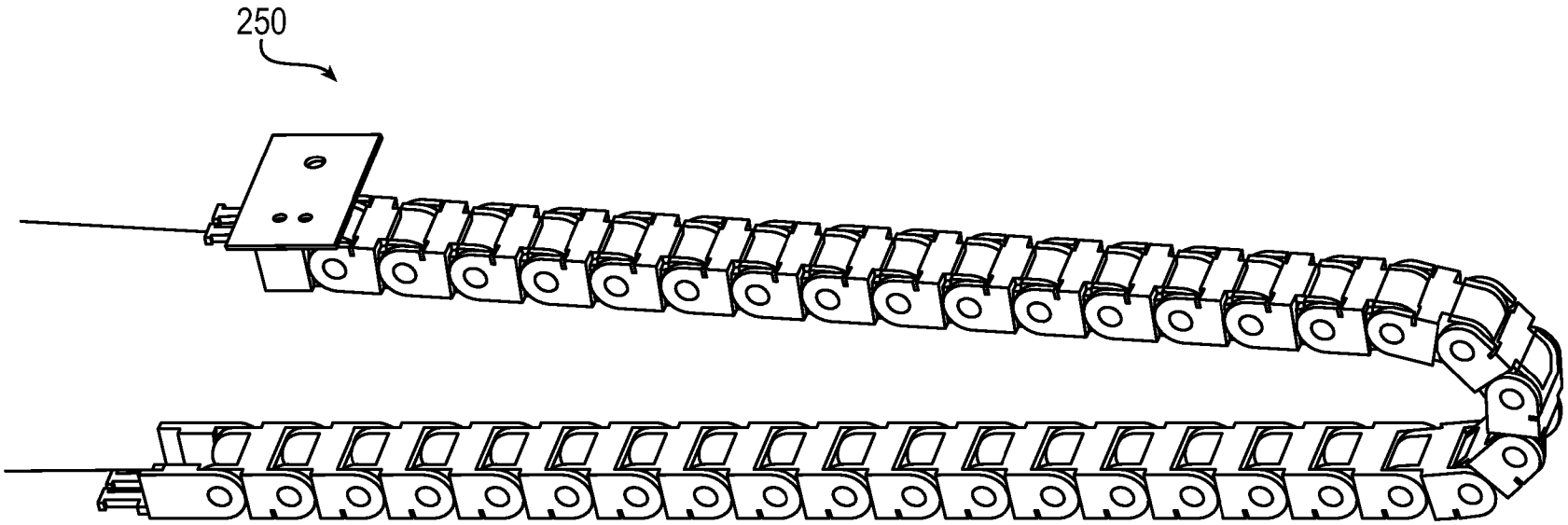
FIG. 23 is a perspective view of a cable track of a tool storage unit, according to an example.

An example of the moveable housing 20 is illustrated in FIGS. 15-22. The moveable housing 20 is illustrated without the display wall 50. In this example, the moveable housing comprises a structure with an open front. Opposite the open from is a back wall configured to receive the display wall and for attaching the display wall. The display wall may also be attached to the sides, top or bottom of the moveable housing. To the top of the moveable housing 20 is the housing top 25. The housing top 25 secures the moveable housing 20 within the base unit when in the closed position. In other words, the housing top 25 closes the base unit opening 35 when in the closed position. Attached to the housing top 25 is a light 90. The light 90 illuminates the inside of the moveable housing 20. More specifically, the light 90 may illuminate the display wall 50. Also attached to the moveable housing 20 is a power strip 70. One or more power strips may be provided in the moveable housing. Adjacent to the power strip 70 is a grommet 75. The power strip 70 may also include internet connectivity, phone connectivity, or other connectivity for use by a user. The grommet 75 provides access into the moveable housing for cables, etc. Cables may extend through grommet 75 into a cable track (See FIG. 23). The cable track 250 is illustrated in FIG. 23 and may be secured to the moveable housing 20 and move with the moveable housing for organizing and maintaining the cables in a secured position during travel. To the bottom of the moveable housing 20, a controller 190 is illustrated. Power to the controller 190 may be provided at the controller by battery or be provided remotely from an external power source. The power supply to the controller 190 may extend from the external power source through the access housing of the base unit and the grommet 75 of the moveable housing 20. As discussed above, the controller 190 may also be provided at an actuator of the moving mechanism (See FIG. 29). A user may operate the moving mechanism, and thereby the tool storage unit, through the controller 190. A user may communicate with the controller 190 remotely, wirelessly and/or at the controller. The controller may also be operated based upon predetermined parameters. By example, the controller may limit or grant access to the moveable housing and/or operate the tool storage unit based upon time of day, duration of use, identification of user, moveable housing position, etc. Additionally, the power supply and the light may be operated through the controller. The controller may also communicate with the light and the power supply based upon the position of the mobile unit. By example, the light may turn on when the moveable housing is moving into or is in the open position. In contrast, the light may turn off when the moveable housing is moving into or is in the closed position.

Figure 24:
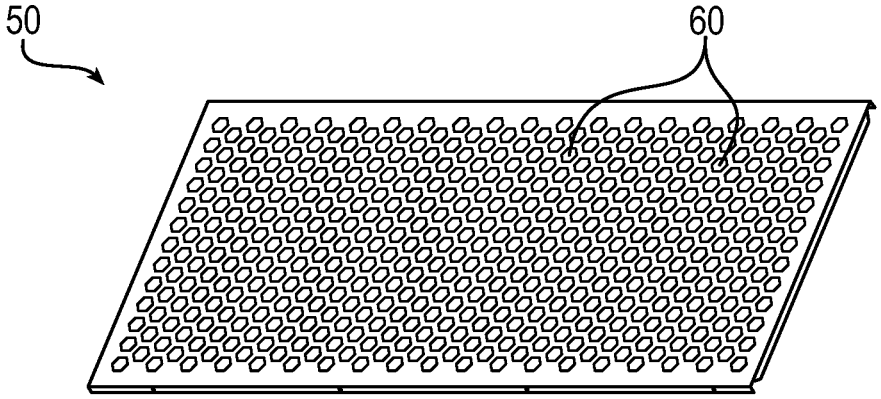
FIG. 24 is a perspective view of a display wall of a tool storage unit, according to an example.
Figure 25:
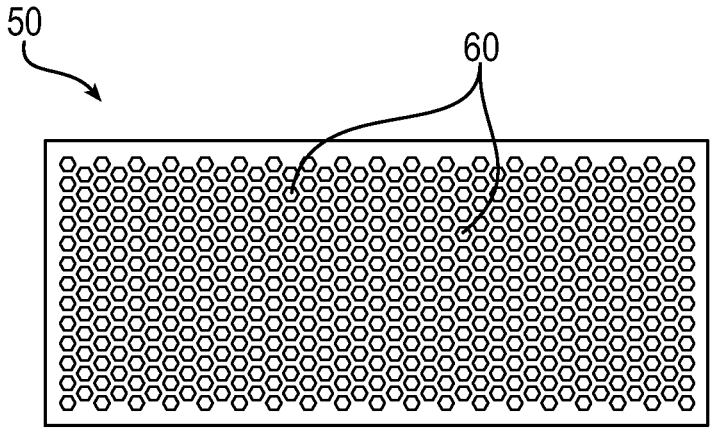
FIG. 25 is a front view of a display wall of a tool storage unit, according to an example.
Figure 26:
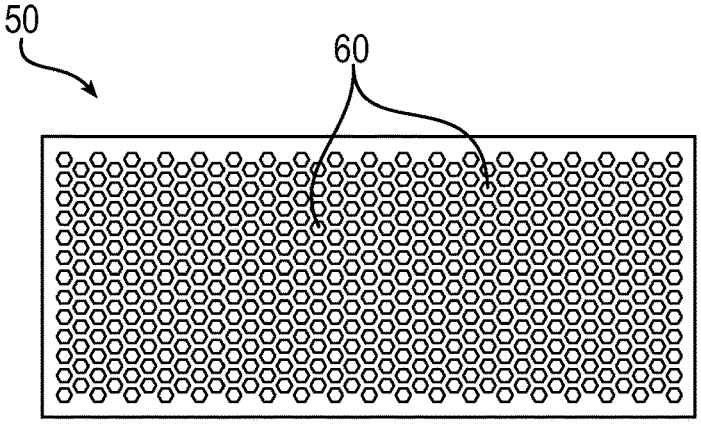
FIG. 26 is a back view of display wall of a tool storage unit, according to an example.
Figure 27:
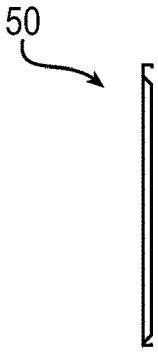
FIG. 27 is a side view of a display wall of a tool storage unit, according to an example.
Figure 28:
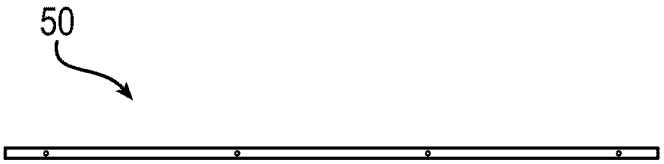
FIG. 28 is a top view of the display wall of a tool storage unit, according to an example.
Figure 29:
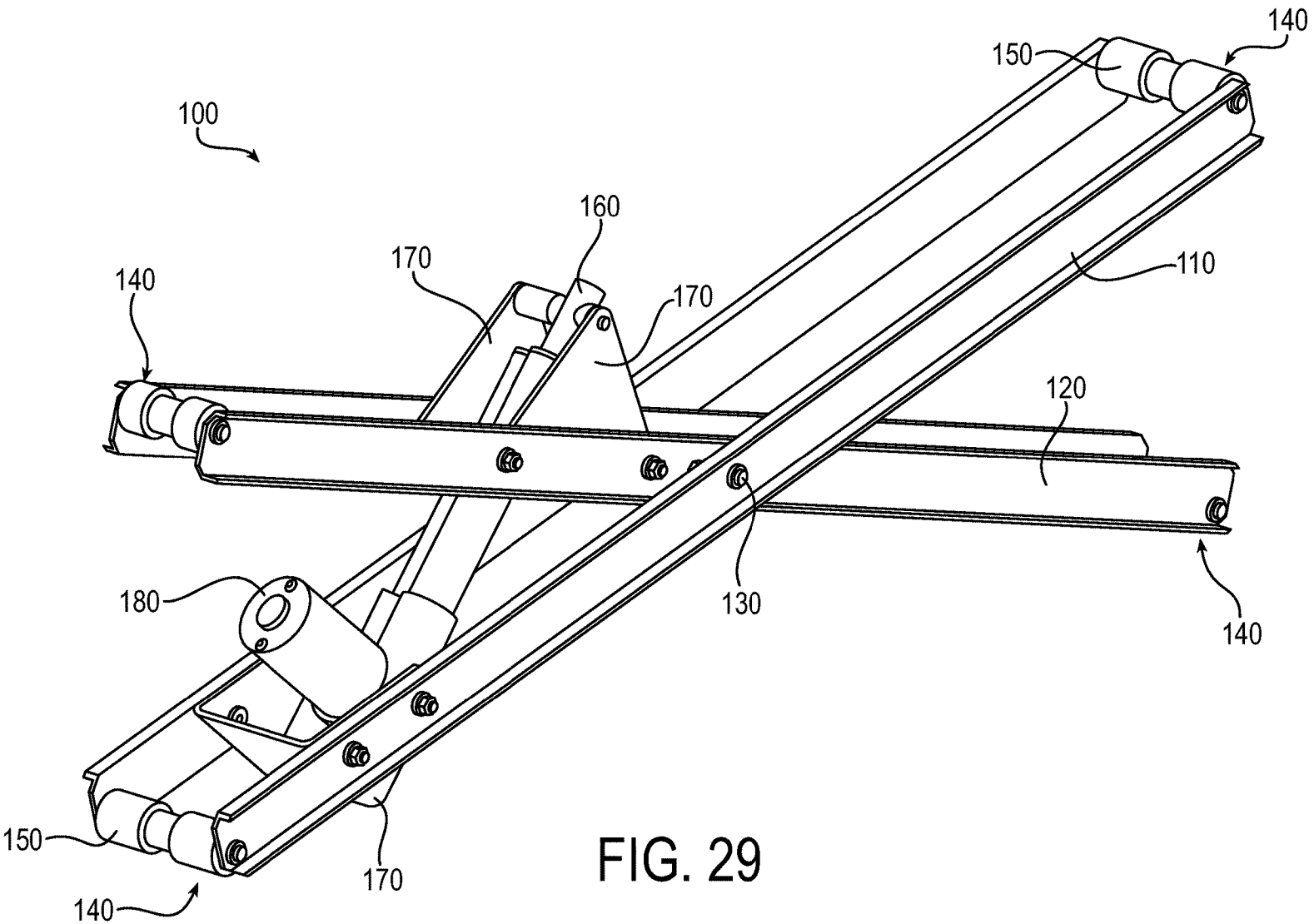
FIG. 29 is a perspective view of a movement mechanism of a tool storage unit, according to an example.
Figure 30:
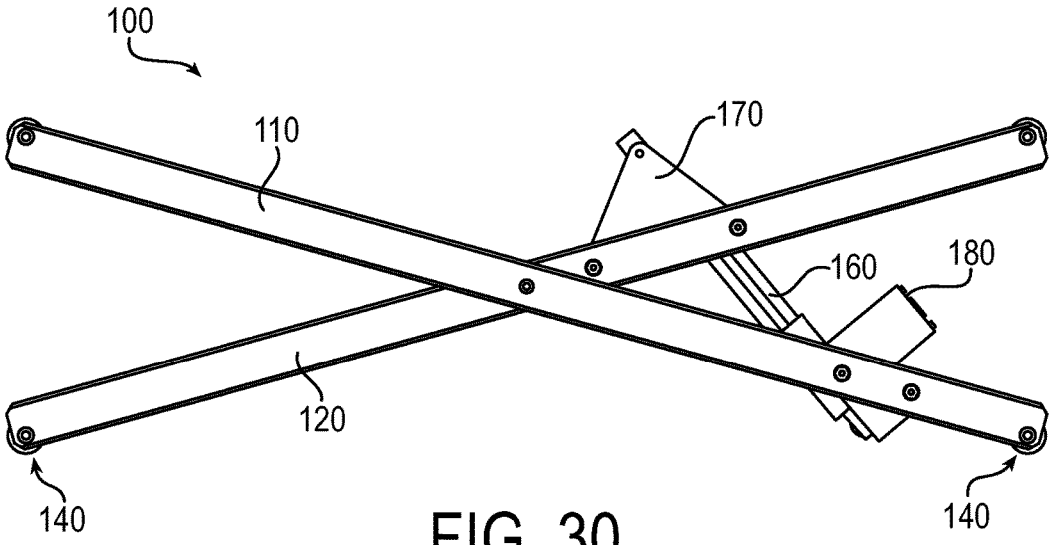
FIG. 30 is a front view of a movement mechanism of a tool storage unit, according to an example.
Figure 31:
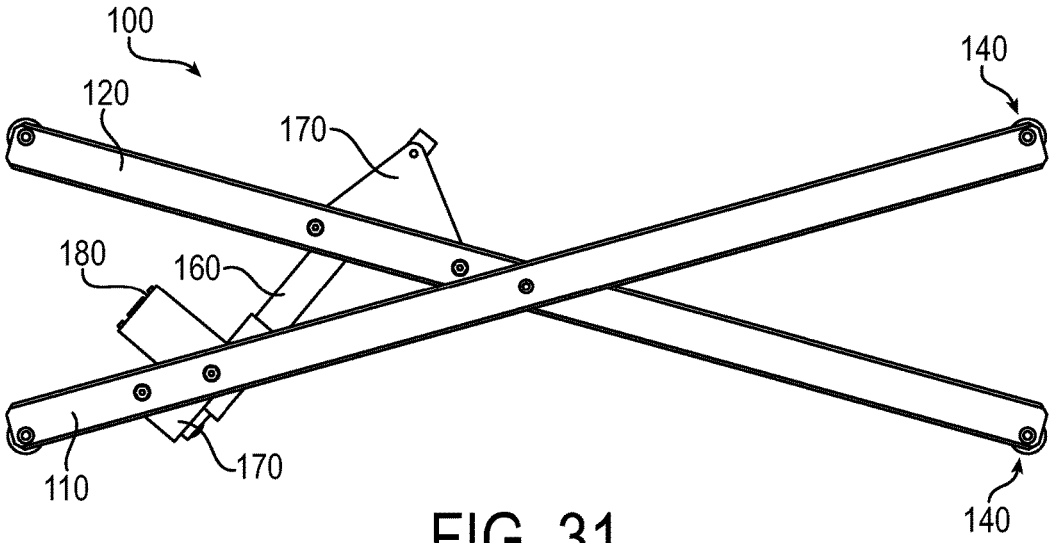
FIG. 31 is a back view of a movement mechanism of a tool storage unit, according to an example.
Figure 32:
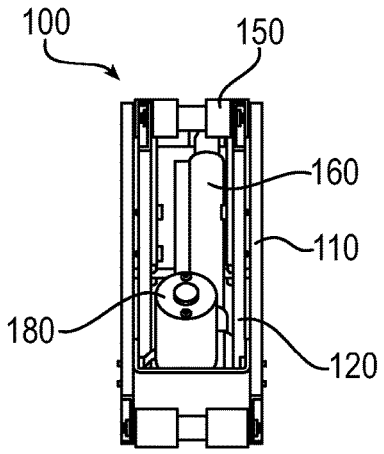
FIG. 32 is a right side view of a movement mechanism of a tool storage unit, according to an example.
Figure 33:
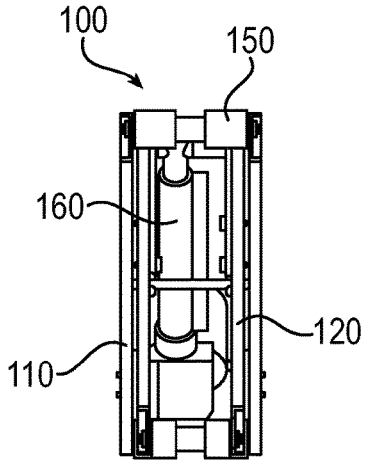
FIG. 33 is a left side view of a movement mechanism of a tool storage unit, according to an example.
Figure 34:
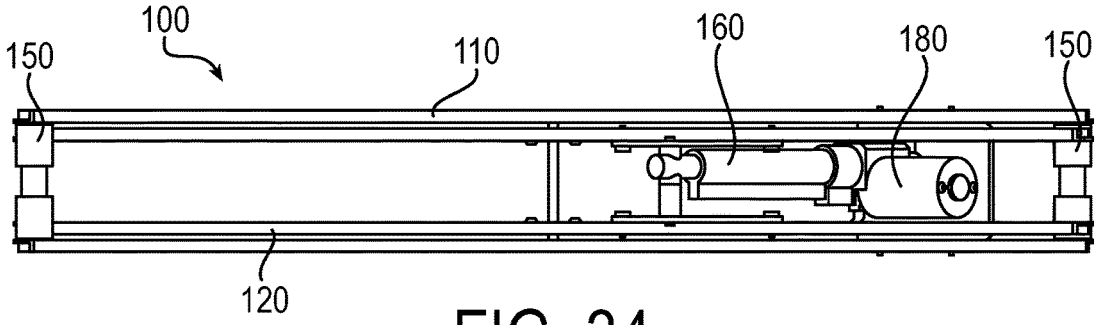
FIG. 34 is a top view of a movement mechanism of a tool storage unit, according to an example.
Figure 35:
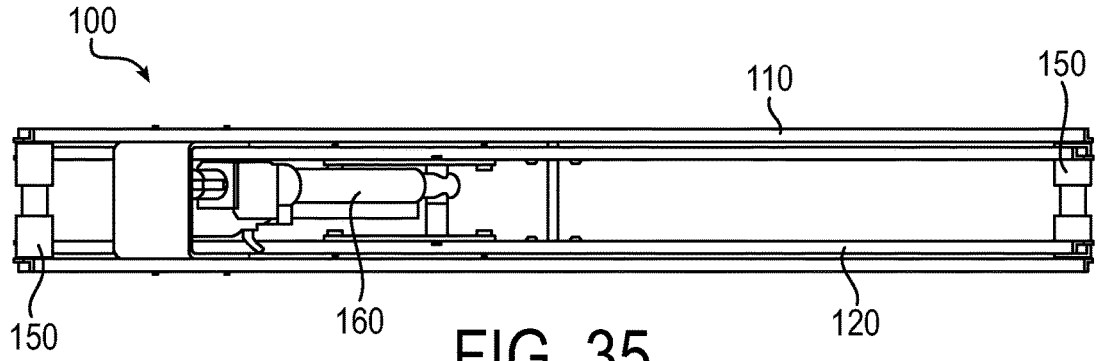
FIG. 35 is a bottom view of the movement mechanism of a tool storage unit, according to an example.

Illustrated in FIGS. 24-28 is a display wall 50. In the present example, the display wall 50 is configured to attach to the back of the moveable housing (See FIGS. 1-2). At the display wall 50 are display apertures 60. The display apertures 60 are configured to receive a hanger or other mechanism configured to receive tools or other items. The storage mechanism may also include drawers or bins, trays or other storage structures for receiving smaller tools including parts or accessories. In FIGS. 24-26, the display apertures 60 are configure as hexagons. The hanging mechanisms may be similarly configured for being inserted into the shape of the display aperture 60 and secured at the display aperture 60 and, in this instance, a hexagon. In one example, the display wall is attached to the moveable housing and is configured to move with the moveable housing. In other examples, the display wall may be configured to move independent of the moveable housing. This may be accomplished by moveably attaching the display wall to the moveable housing or attaching the display wall to the base unit or moving mechanism in combination with or independent of the moveable housing. A moving mechanism may be independently attached to display wall separate from the moving mechanism used with the moveable housing. In FIGS. 24-26, the display wall 50 is configured to have a void between the back of the display wall and the back wall of the moveable housing. This may be accomplished by spacers that separate the display wall 50 from the moveable housing. This allows the hanging mechanisms to be inserted into and through the display apertures 60 for being secured to the display aperture 60. The display wall may move in relative to the back wall and, thereby, reduce the void between the back of the display wall and the back wall to lock the hanging mechanisms into the display apertures. In other examples, the display wall may be secured directly to the moveable housing with the hanging mechanisms being secured to the face of the display wall 50. In addition to or as an alternative to the display wall, alternative storage structures may be provided within the moveable housing. By example, drawers, cabinets, bins, shelves, etc. may be provided in and move in combination with the moveable housing. These alternative storage structures may additionally be secured to the display wall using the hanging mechanisms.

Turning to FIGS. 29-35, one example of a moving mechanism 100 is illustrated. In this example, the moving mechanism 100 is a scissor lift. The scissor lift comprises a first arm 110 and a second arm 120. The first arm 110 and the second arm 120 are connected at a pivot point 130 and rotate about this pivot point. To each end of the first arm 110 and the second arm 120 are guiding structures 150. In this particular example, the guiding structures 150 are neoprene rollers. The guiding structures 150 are configured to engage the base unit and/or the moveable housing at points of engagement 140. Additional guiding structures may be provided at the base unit and/or the moveable housing, as described above. In this example, the moving mechanism 100 is operated by a piston 160 connected to the first arm 110 and the second arm 120 by mounting brackets 170. The piston 160 extends and contracts moving the first arm 110 and the second arm 120 in relation to the other about the pivot point 130. Attached to the piston 160 is an actuator for driving the piston 160. As discussed above, the controller sends a signal to the actuator 180 and initiates movement of the piston 160. The controller may be provided at any location on the tool storage unit including at the actuator. In some examples the controller may be provided independent of the tool storage unit. In operation, the moving mechanism is positioned between the base unit and the moveable housing and providing movement between the base of the base unit and the moveable housing. In this particular example, the movement mechanism lifts the moveable housing through the base unit opening.

Figure 36:
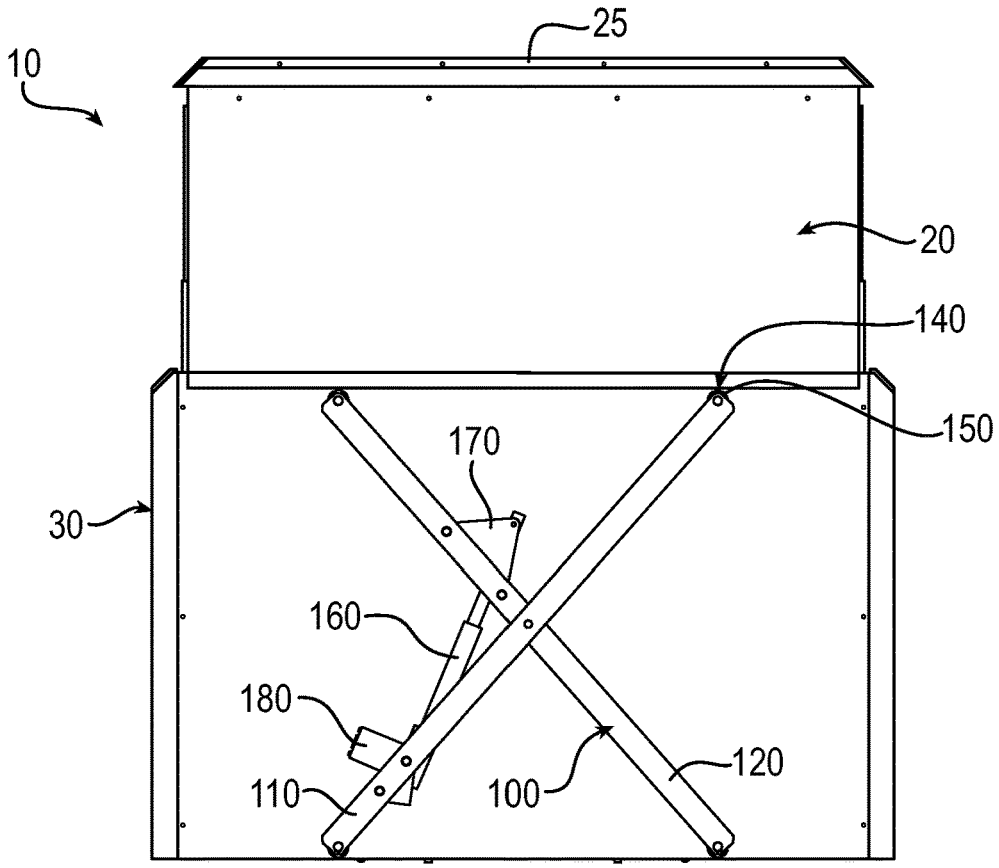
FIG. 36 is a back view of the tool storage unit in the open position with a back housing of the base unit removed, according to an example.

FIG. 36 illustrates the tool storage unit 10 in the open position with a back housing of the base unit 30 removed. This provides a view of the moving mechanism 100 positioned between the base unit 30 and the moveable housing 20. In some examples, the base unit 30 may not have a back housing. In the open position, the moving mechanism 100 and piston 160 are fully extended or at full extension. The full extension of the moving mechanism 100 and/or piston 160 may be limited by a pre-determined distance or set parameters. In other words, the capacity of the moving mechanism or piston may extend further than the limit defined as full extension. At full extension, the moveable housing 20 has been lifted through the base unit opening 35 by the moving mechanism 100. The moveable housing 20 may be additionally guided by the track(s) 40 connecting the moveable housing 20 to the base unit 30. The guiding structures 150 of the moving mechanism move across the base of the moveable housing 20 and at the bottom of the base unit 30 as the moving mechanism lifts the moveable housing 20. The actuator 180 forces the piston 160 to move the first arm 110 in relation to the second arm 120 making the moveable housing 20 move in relation to the base unit 30. The moving mechanism may be anchored into the base unit and/or the moveable housing to maintain the position of the moving mechanism relative to each.

Figure 37:
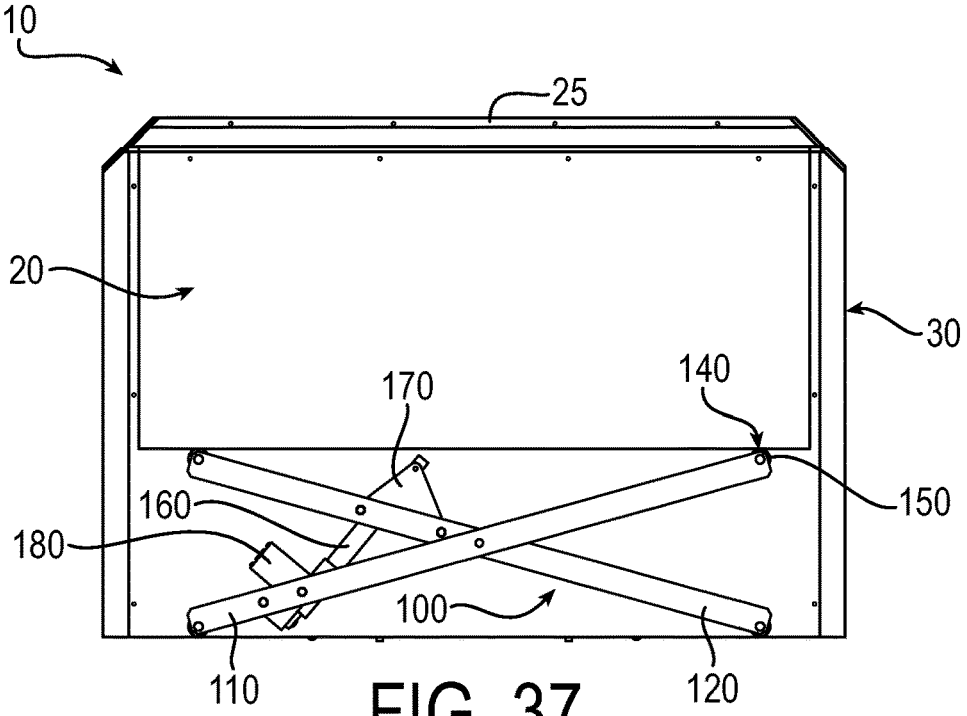
FIG. 37 is a back view of the tool storage unit in the closed position with a back housing of the base unit removed, according to an example.

FIG. 37 illustrates the tool storage unit 10 in the closed position with a back housing of the base unit 30 removed. Again, this provides a view of the moving mechanism 100 positioned between the base unit 30 and the moveable housing 20. In the closed position, the moving mechanism 100 and piston 160 are fully contracted or at full contraction. Similar to the extension, the full contraction of the moving mechanism 100 and/or piston 160 may be limited by a pre-determined distance or set parameters. In other words, the capacity of the moving mechanism or piston may extend further than the limit defined as full contraction. In this particular example, full contraction is limited by the housing top 25 being engaged with the base unit 30 and sealing the base unit opening 35. This prevents access into the moveable housing 20 and thereby prevents access to the items stored at the display wall 50. As indicated above, as the moving mechanism 100 and piston 160 move between full contraction and full extension, the guiding structures 150 positioned to each end of the first arm 110 and second arm 120 translate across the moveable housing 20 and the base unit 30 at the points of engagement.

Figure 38:
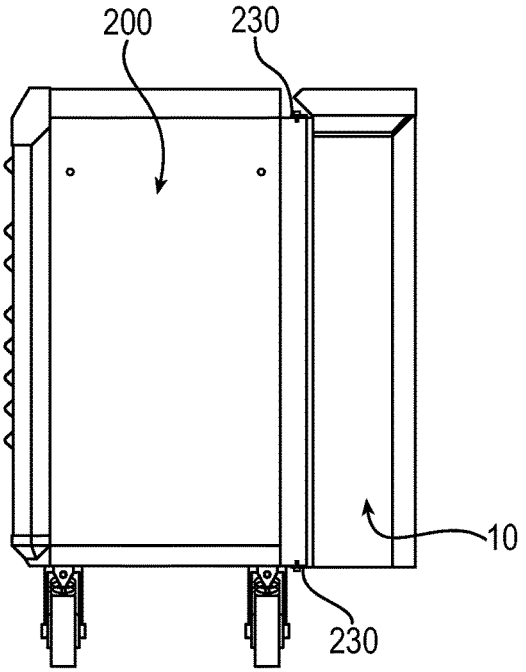
FIG. 38 is a right side view of a tool storage unit in the closed position and attached to a tool chest, according to an example.
Figure 39:
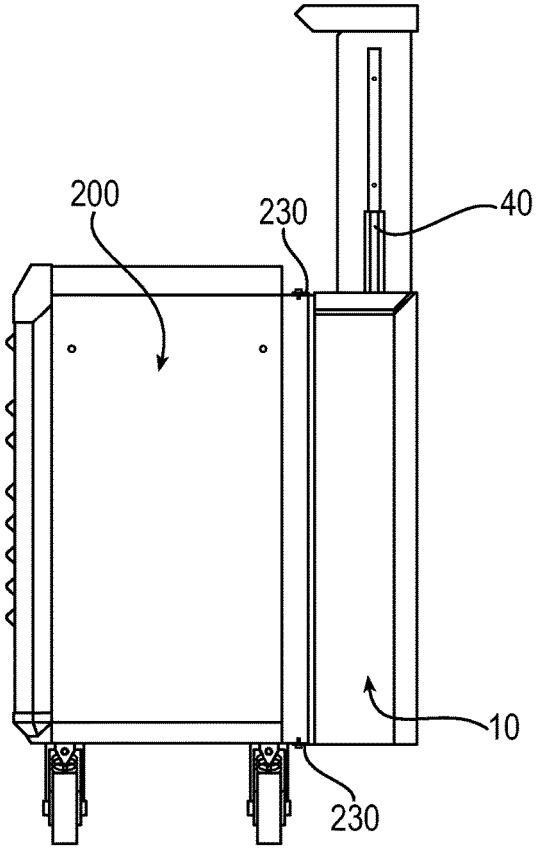
FIG. 39 is a right side view of a tool storage unit in the open position and attached to a tool chest, according to an example.
Figure 41:
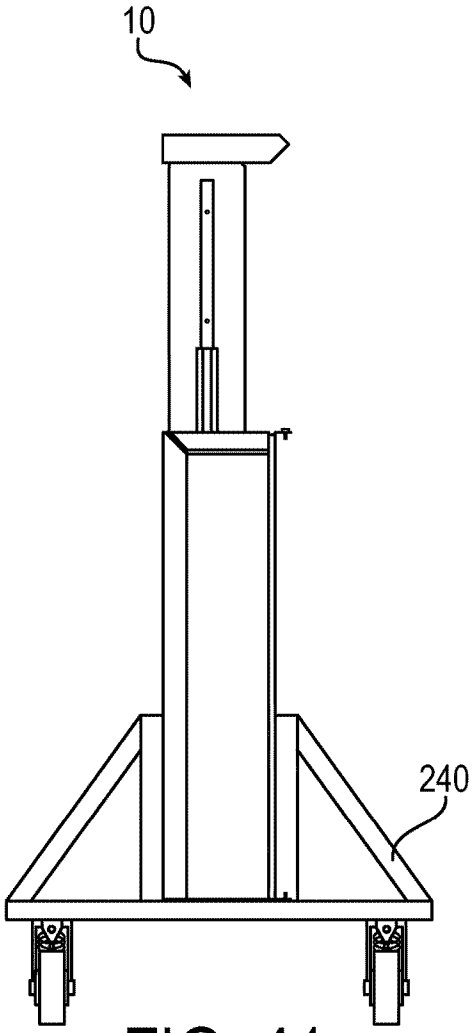
FIG. 41 is a front view of a tool storage unit connected to a mobile base, according to an example.
Figure 40:
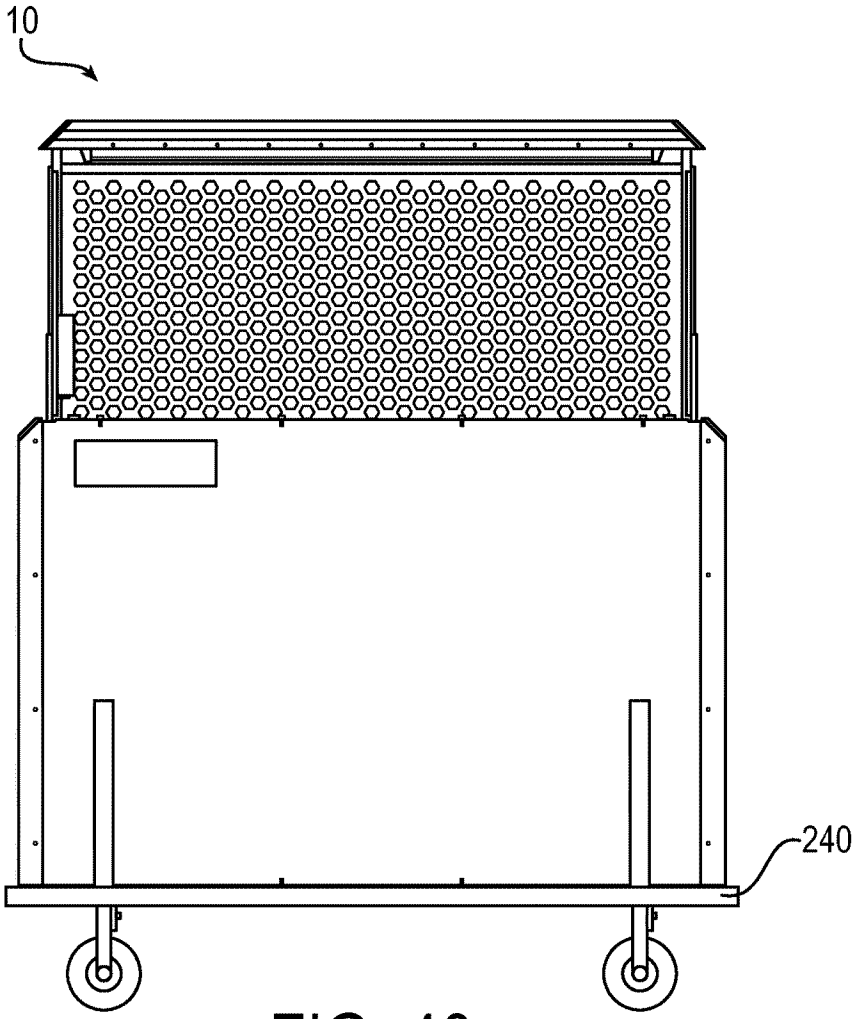
FIG. 40 is a left side view of a tool storage unit connected to a mobile base, base, according to an example.

FIG. 38 illustrates a tool storage unit 10 attached to another structure. In this example, the tool storage unit 10 is attached to a tool chest 200. As discussed in more detail above, the tool storage unit 10 is attached to the tool chest 200 by attachment system or members 230 at the base unit 30. In particular, the tool chest 200 of this example is a mobile cart. Upon being attached to the tool chest 200, the tool storage unit 10 moves with the tool chest 200. In this particular example, the weight of the tool chest 200, including the drawers of the tool chest, act as a counterbalance for the weight of the tool storage unit 10. Therefore, the tool storage unit 10 does not require an independent base, aside from being attached to the tool chest 200. In the closed position, the tool storage unit 10, which is attached to the back of the tool chest 200, is concealed by the tool chest 200 when facing the tool chest 200 directly from the front. The housing top 25 of the tool storage unit 10 is flush with the top surface of the tool chest 200. In other examples, the tool storage unit may be smaller or larger than the tool chest 200 or may extend about or be concealed by the perimeter of the tool chest 200. In FIG. 39, the tool storage unit 10 is attached to a tool chest 200 and is in the open position. Again, the weight of the tool chest 200 acts as a counterbalance for the weight of the tool storage unit 10 in the open position. In the open position, the track 40 secures the moveable housing 20 in the upright position in relation to the base unit 30. In another example and as illustrated by FIGS. 40-41, the tool storage unit 10 is connected to a mobile base 240.

The terms "comprising," "including," and "having," as used in the claims and specifications herein, shall be considered as indicating an open group that may include other elements not specified. The terms "a," "an," and the singular forms of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (i.e., not required) feature.

While the tool storage unit has been described with reference to particular examples thereof, it shall be understood that such description is by way of illustration only and should not be construed as limiting the scope of the claims. Accordingly, the scope and content are to be defined only by the terms of the following claims. Furthermore, it is understood that the features of any specific example discussed herein may be combined with one or more features of any one or more examples otherwise discussed or contemplated herein unless otherwise noted.

What is claimed is:

1. A tool storage unit comprising:

a moveable housing provided in association with a base unit where the base unit is removably connected to a backside of a tool chest using mounting brackets positioned to a front side of the base unit;

a moving mechanism engaged with the moveable housing; and a controller to control operation of the moving mechanism wherein the controller operates the moving mechanism to move the moveable housing between at least three positions including an open position with the moveable housing raised vertically and fully extended from the base unit, a closed position with the moveable housing lowered vertically and positioned within the base unit, and at least one intermediate position between the open position and the closed position wherein the moveable housing includes a storage area that is at least partially accessible when in the open position, is partially accessible when in the at least one intermediate position, is substantially concealed in the base unit when in the closed position, and wherein the at least one intermediate position is defined by an auto stop.

2. The tool storage unit of claim 1 further comprising a travel mechanism associated with the moveable housing to translate at least a portion of the moveable housing outside of the base unit.

3. The tool storage unit of claim 1 wherein the movable housing is configured to pivot, rotate, or collapse into another position relative to the base unit.

4. The tool storage unit of claim 1 wherein the moving mechanism is powered and further comprising a manual movement mechanism associated with the moveable housing in combination with the moving mechanism.

5. The tool storage unit of claim 1 further comprising internet access or connection at the tool storage unit.

6. The tool storage unit of claim 1 wherein a user may operate the controller remotely.

7. The tool storage unit of claim 1 wherein the controller moves the moveable housing between the open position, the closed position, and the at least one intermediate position based upon predetermined parameters selected from a group consisting of limiting or granting access to the moveable housing based upon time of day, duration of use, identification of user, or combinations thereof.

8. The tool storage unit of claim 1 further comprising a power supply and at least one light which are operated by the controller which turns on the light and the power supply upon the moveable housing being positioned in the open or at least one intermediate position.

9. The tool storage unit of claim 1 wherein the moveable housing includes a display wall and wherein the display wall is moveable to a position to be accessible from multiple sides.

10. The tool storage unit of claim 1 further comprising a torque sensor to sense torque on the movable housing.

11. The tool storage unit of claim 1 further comprising one or more sensors to sense an obstruction to stop or reverse movement of the moveable housing when an obstruction is detected.

12. The tool storage unit of claim 1 where the moveable housing includes a mounting structure for attaching one or more tools or attachments, the mounting structure including a display wall having one or more apertures where the display wall translates relative to the moveable housing.

13. The storage unit of claim 1 wherein the moveable housing includes at least two storage compartments in designated portions of the moveable housing and the at least two storage compartments are accessible when in the open position, have limited access in the intermediate position, and are substantially concealed in the base unit when in the closed position.

14. A tool storage unit comprising:

a storage unit comprising a base unit and moveable housing in association with the base unit where the base unit is removably connected to a backside of a tool chest using mounting brackets positioned to a front side of the base unit; and a moving mechanism engaged with the moveable housing and a controller to operate the moving mechanism to move the moveable housing vertically from within the base unit between at least a first position, a second position, and at least one intermediate position defined by a friction structure and an auto stop and wherein the movable housing includes a storage area that is at least partially accessible when in the first position, is partially accessible when in the least one intermediate position, and is substantially concealed in the base unit when in the second position.

15. A storage unit comprising:

a moveable housing in association with a base unit where the base unit is removably connected to a backside of a tool chest using mounting brackets positioned to a front side of the base unit;

a moving mechanism engaged with the moveable housing to move the moveable housing vertically from within the base unit between at least a first position, a second position, and at least one intermediate position there between;

a controller to control operation of the moving mechanism wherein the controller operates the moving mechanism to move the moveable housing;

wherein the controller moves the moveable housing between the first position, the second position, and the at least one intermediate position based upon predetermined parameters selected from a group consisting of limiting or granting access to the moveable housing based upon time of day, duration of use, identification of user, or combinations thereof; wherein the movable housing includes a storage area that is at least partially accessible when in the first position, is partially accessible when in the least one intermediate position, and is substantially concealed in the base unit when in the second position; and wherein the at least one intermediate position is defined by an auto stop.

16. The storage unit of claim 15, wherein the intermediate position grants access to a portion of the moveable housing based on time of day or duration of use.

17. The storage unit of claim 15 further comprising one or more sensors to sense an obstruction to control movement of the moveable housing when an obstruction is detected.

* * * * *